US009133572B2

(12) United States Patent
Nishimura et al.

(10) Patent No.: US 9,133,572 B2
(45) Date of Patent: Sep. 15, 2015

(54) SEWING MACHINE AND NON-TRANSITORY COMPUTER READABLE STORAGE MEDIUM STORING PROGRAM

(71) Applicants: Yoshio Nishimura, Nagoya (JP); Satoru Makino, Nagoya (JP); Yoshinori Nakamura, Toyohashi (JP); Yutaka Nomura, Anjo (JP); Akie Shimizu, Nagoya (JP); Yuki Ihira, Kakamigahara (JP); Daisuke Abe, Nagoya (JP)

(72) Inventors: Yoshio Nishimura, Nagoya (JP); Satoru Makino, Nagoya (JP); Yoshinori Nakamura, Toyohashi (JP); Yutaka Nomura, Anjo (JP); Akie Shimizu, Nagoya (JP); Yuki Ihira, Kakamigahara (JP); Daisuke Abe, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 295 days.

(21) Appl. No.: 13/789,061

(22) Filed: Mar. 7, 2013

(65) Prior Publication Data

US 2013/0233222 A1 Sep. 12, 2013

(30) Foreign Application Priority Data

Mar. 12, 2012 (JP) ..... 2012-055105

(51) Int. Cl.
*D05B 19/12* (2006.01)

(52) U.S. Cl.
CPC ..... *D05B 19/12* (2013.01)

(58) Field of Classification Search
CPC ..... D05C 9/04; D05C 9/22
USPC ..... 700/136–138; 112/102.5
See application file for complete search history.

(56) References Cited

U.S. PATENT DOCUMENTS

| | | | | |
|---|---|---|---|---|
| 3,966,331 | A | 6/1976 | Inuiya | |
| 4,712,497 | A * | 12/1987 | Nomura et al. | 112/315 |
| 4,998,489 | A | 3/1991 | Hisatake et al. | |
| 5,072,680 | A * | 12/1991 | Nakashima | 112/445 |
| 5,195,451 | A * | 3/1993 | Nakashima | 112/102.5 |
| 5,553,559 | A * | 9/1996 | Inoue et al. | 112/102.5 |
| 5,855,176 | A * | 1/1999 | Takenoya et al. | 112/102.5 |
| 6,000,350 | A | 12/1999 | Koike et al. | |
| 6,167,822 | B1 * | 1/2001 | Miyasako et al. | 112/102.5 |

(Continued)

FOREIGN PATENT DOCUMENTS

| | | |
|---|---|---|
| JP | S61-131787 A | 6/1986 |
| JP | S64-040386 | 3/1989 |

(Continued)

OTHER PUBLICATIONS

U.S. Appl. No. 13/788,903, filed Mar. 7, 2013 in the name of Yoshio Nishimura et al.

(Continued)

*Primary Examiner* — Danny Worrell
(74) *Attorney, Agent, or Firm* — Oliff PLC

(57) ABSTRACT

A sewing machine that includes a processor, a plurality of detection devices that is configured to be capable of changing mounting positions and configured to detect an ultrasonic wave, and a memory that is configured to store computer-readable instructions that instruct the sewing machine to execute steps comprising, identifying, when a first ultrasonic wave transmitted from a transmission source of the ultrasonic wave is detected by the detection devices, a position of the transmission source of the first ultrasonic wave, based on information relating to the detected first ultrasonic wave, and controlling sewing based on the identified position of the transmission source of the first ultrasonic wave.

5 Claims, 15 Drawing Sheets

(56) References Cited

U.S. PATENT DOCUMENTS

| | | | | |
|---|---|---|---|---|
| 6,871,606 | B2 * | 3/2005 | Schweizer | 112/475.02 |
| 6,883,446 | B2 | 4/2005 | Koerner | |
| 7,079,917 | B2 | 7/2006 | Taguchi et al. | |
| 7,155,302 | B2 * | 12/2006 | Muto et al. | 700/138 |
| 7,373,891 | B2 | 5/2008 | Koerner | |
| 7,854,207 | B2 * | 12/2010 | Kuki et al. | 112/102.5 |
| 8,061,286 | B2 | 11/2011 | Hirata et al. | |
| 8,074,590 | B2 | 12/2011 | Bentley | |
| 8,286,568 | B2 * | 10/2012 | Tokura | 112/102.5 |
| 8,301,292 | B2 * | 10/2012 | Tokura | 700/138 |
| 8,528,491 | B2 | 9/2013 | Bentley | |
| 8,567,329 | B2 | 10/2013 | Kishi | |
| 8,763,542 | B2 | 7/2014 | Abe et al. | |
| 2004/0182295 | A1 | 9/2004 | Pfeifer | |
| 2009/0188413 | A1 | 7/2009 | Hirata et al. | |
| 2011/0048299 | A1 * | 3/2011 | Tokura | 112/102.5 |
| 2011/0226170 | A1 * | 9/2011 | Tokura | 112/470.05 |
| 2012/0000249 | A1 * | 1/2012 | Hamada | 65/424 |
| 2012/0111249 | A1 | 5/2012 | Sekine | |
| 2012/0210925 | A1 | 8/2012 | Koga et al. | |
| 2013/0233217 | A1 | 9/2013 | Shimizu et al. | |
| 2013/0233219 | A1 | 9/2013 | Nakamura et al. | |
| 2013/0233220 | A1 | 9/2013 | Nomura et al. | |
| 2013/0233221 | A1 | 9/2013 | Abe et al. | |
| 2013/0233222 | A1 | 9/2013 | Nishimura et al. | |
| 2014/0000498 | A1 | 1/2014 | Yamanashi et al. | |

FOREIGN PATENT DOCUMENTS

| | | |
|---|---|---|
| JP | A-06-000264 | 1/1994 |
| JP | A-2007-128120 | 5/2007 |
| JP | A-2009-172123 | 8/2009 |

OTHER PUBLICATIONS

U.S. Appl. No. 13/788,928, filed Mar. 7, 2013 in the name of Yoshinori Nakamura et al.

U.S. Appl. No. 13/789,046, filed Mar. 7, 2013 in the name of Daisuke Abe et al.

U.S. Appl. No. 13/788,979, filed Mar. 7, 2013 in the name of Yutaka Nomura et al.

U.S. Appl. No. 13/788,893, filed Mar. 7, 2013 in the name of Akie Shimizu et al.

Jul. 30, 2014 Office Action issued in U.S. Appl. No. 13/788,903.

Feb. 4, 2014 Office Action issued in Japanese Patent Application No. 2012-055103 (with English Translation).

Mar. 4, 2014 Office Action issued in U.S. Appl. No. 13/788,979.

Mar. 3, 2015 Office Action issued in Japanese Application No. 2014-059717.

Mar. 10, 2015 Patent Office Communication issued in U.S. Appl. No. 13/788,893.

Feb. 20, 2015 Office Action issued in U.S. Appl. No. 13/788,893.

* cited by examiner

SEWING MACHINE AND NON-TRANSITORY COMPUTER READABLE STORAGE MEDIUM STORING PROGRAM

CROSS-REFERENCE TO RELATED APPLICATION

This application claims priority to Japanese Patent Application No. 2012-055105, filed Mar. 12, 2012, the content of which is hereby incorporated herein by reference in its entirety.

BACKGROUND

The present disclosure relates to a sewing machine and a non-transitory computer-readable storage medium storing a program that are capable of performing sewing in a specified position on a work cloth.

Conventionally, a sewing machine is known that can easily set a sewing position and a sewing angle on a work cloth when sewing a desired embroidery pattern. For example, a sewing machine is disclosed that is provided with an imaging device that captures an image of a marker adhered in a specified position on the work cloth, and that automatically sets the sewing position and the sewing angle of the embroidery pattern based on an image of the marker that is captured.

SUMMARY

However, in the above-described sewing machine, it is necessary to adhere the marker to the work cloth. Further, after the sewing machine sets the sewing position and the sewing angle of the embroidery pattern, it is necessary to remove the marker that is adhered to the work cloth before performing the sewing, thus making operations troublesome.

It is an object of the present disclosure to provide a sewing machine and a non-transitory computer-readable storage medium storing a program that allow a user to easily set a position on a work cloth on which sewing is to be performed.

A sewing machine according to a first aspect of the present disclosure includes a processor, a plurality of detection devices, and a memory. The plurality of detection devices is configured to be capable of changing mounting positions and configured to detect an ultrasonic wave. The memory is configured to store computer-readable instructions that instruct the sewing machine to execute steps including identifying, when a first ultrasonic wave transmitted from a transmission source of the ultrasonic wave is detected by the detection devices, a position of the transmission source of the first ultrasonic wave, based on information relating to the detected first ultrasonic wave, and controlling sewing based on the identified position of the transmission source of the first ultrasonic wave.

A non-transitory computer-readable medium according to a second aspect of the present disclosure stores computer-readable instructions that instruct a sewing machine. The sewing machine includes a plurality of detection devices configured to be capable of changing mounting positions and configured to detect an ultrasonic wave. The computer-readable instructions instruct the sewing machine to execute steps including identifying, when a first ultrasonic wave transmitted from a transmission source of the ultrasonic wave is detected by the detection devices, a position of the transmission source of the first ultrasonic wave, based on information relating to the detected first ultrasonic wave, and controlling sewing based on the identified position of the transmission source of the first ultrasonic wave.

BRIEF DESCRIPTION OF THE DRAWINGS

Exemplary embodiments of the invention will be described below in detail with reference to the accompanying drawings in which.

DETAILED DESCRIPTION OF THE EXEMPLARY EMBODIMENTS

Hereinafter, an exemplary embodiment of the present disclosure will be explained with reference to the drawings. Note that the drawings are used to explain technological features that the present disclosure can utilize, and are intended in no way to limit the present disclosure. A physical configuration of a sewing machine 1 will be explained with reference to FIG. 1. In the following explanation, the front side, the depth side, the upper side, the lower side, the left side and the right side of FIG. 1 are, respectively, the front side, the rear side, the upper side, the lower side, the left side and the right side of the sewing machine 1.

Figure 1:
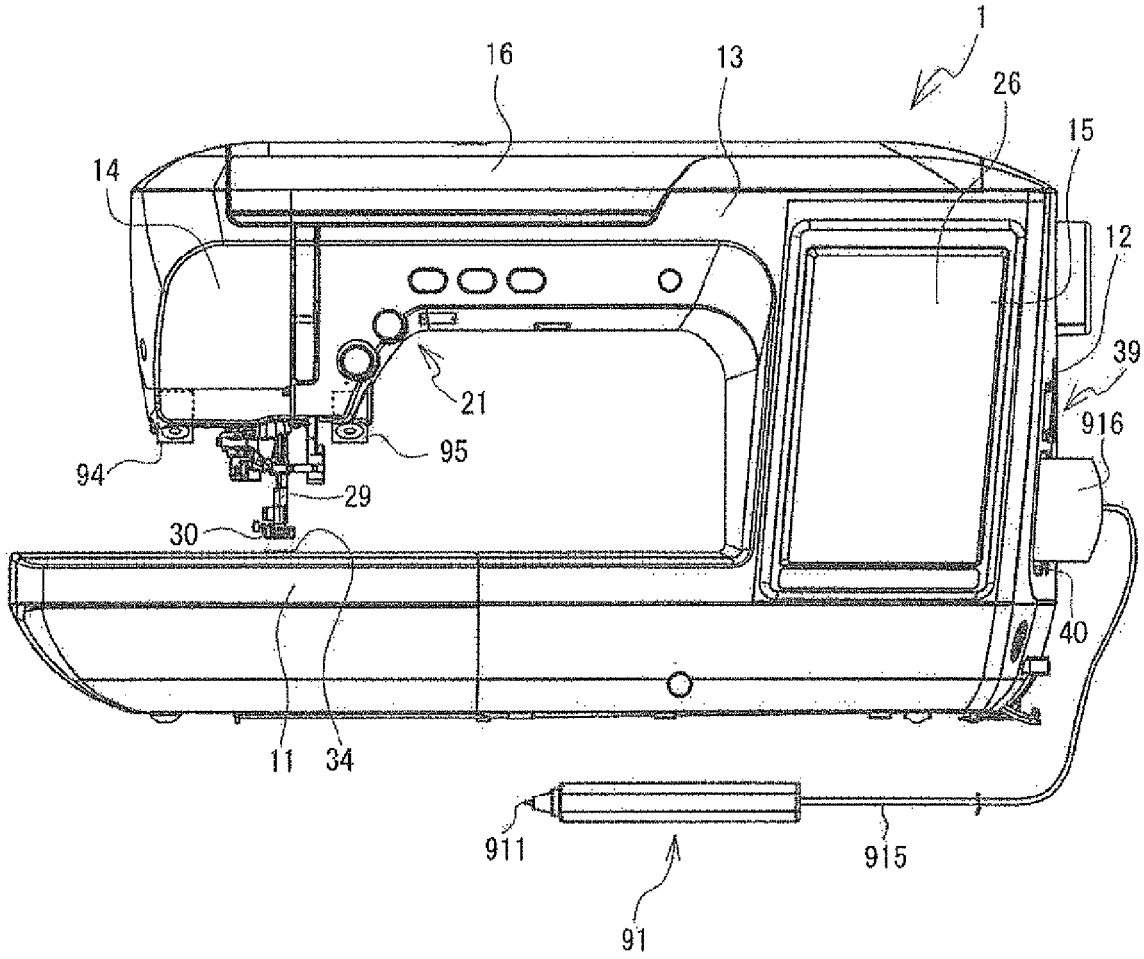
FIG. 1 is a front view of a sewing machine 1.

As shown in FIG. 1, the sewing machine 1 is provided with a sewing machine bed 11, a pillar 12, an arm portion 13, and a head portion 14. The sewing machine bed 11 extends in the left-right direction. The pillar 12 is provided such that it rises upward from the right end of the sewing machine bed 11. The arm portion 13 extends to the left from the upper end of the pillar 12. The head portion 14 is provided on the left side of the arm portion 13. A needle plate (not shown in the drawings), a feed dog 34, a cloth feed mechanism (not shown in the drawings), a feed adjustment motor 83 (refer to FIG. 5), and a shuttle mechanism (not shown in the drawings) are provided within the sewing machine bed 11. The needle plate is disposed on the top surface of the sewing machine bed 11. The feed dog 34 is provided on a lower side of the needle plate and feeds, by a specified feed amount, a work cloth 100 (refer to FIG. 6) on which sewing is performed. The cloth feed mechanism drives the feed dog 34. The feed adjustment motor 83 adjusts the feed amount. A needle bar mechanism (not shown in the drawings), a needle swinging motor 80 (refer to FIG. 5), and a thread take-up lever mechanism (not shown in the drawings) are provided in the head portion 14. The needle bar mechanism moves a needle bar (not shown in the drawings) on which a sewing needle 29 is mounted, in the up-down direction. The needle swinging motor 80 swings the needle bar in the left-right direction. Two receivers 94 and 95 are provided on a rear portion of the lower edge of the head portion 14 such that the receivers 94 and 95 are separated to the left and to the right. As will be explained in more detail later, mounting positions of the receivers 94 and 95 can be changed to given positions. In FIG. 1, as a specific example, the receivers 94 and 95 are mounted on the rear portion of the lower edge of the head portion 14. The receivers 94 and 95 detect an ultrasonic wave transmitted by an ultrasonic pen 91 (to be explained later).

A vertically rectangular liquid crystal display (LCD) 15 is provided on the front face of the pillar 12. For example, keys to execute various functions necessary to the sewing operation, various messages and various patterns etc. are displayed on the LCD 15.

A transparent touch panel 26 is provided in the upper surface (front surface) of the LCD 15. Pattern selection and various settings etc. can be carried out by pressing positions (performing a pressing operation) on the touch panel 26 that correspond to the various keys etc. that are displayed on the LCD 15 using a finger or a dedicated touch pen. The above-described pressing operation is hereinafter referred to as a "panel operation."

A connector 39 and a connector 40 are provided in the right side face of the pillar 12. An external storage device (not shown in the drawings), such as a memory card, can be connected to the connector 39. Via the connector 39, the sewing machine 1 can read, into the sewing machine 1, pattern data and various programs from the external storage device, and can output to the outside of the sewing machine 1. A connector 916, which is provided on an end of a cable 915 that extends from the ultrasonic pen 91 (to be explained later), is connected to the connector 40. Via the connector 40, the sewing machine 1 supplies electric power to the ultrasonic pen 91 and detects various signals (an transmission start signal etc. that will be explained later) output from the ultrasonic pen 91.

Next, the structure of the arm portion 13 will be explained. A cover 16 that opens and closes an upper portion of the arm portion 13 is attached to the upper portion of the arm portion 13. The cover 16 is provided in the longitudinal direction of the arm portion 13 and is axially supported such that it can be opened and closed by being rotated about an axis that extends in the left-right direction at the upper rear edge of the arm portion 13. A thread spool pin (not shown in the drawings), on which a thread spool that supplies thread to the sewing machine 1 is mounted, is provided underneath the cover 16 in the interior of the arm portion 13. Although not shown in the drawings, an upper thread that extends from the thread spool is supplied to the sewing needle 29 that is mounted on the needle bar, via a plurality of thread hooks that are provided on the head portion 14, such as a tensioner, a thread take-up spring, and a thread take-up lever.

A sewing machine motor 79 (refer to FIG. 5) is provided in the arm portion 13. The sewing machine motor 79 rotates a sewing machine drive shaft (not shown in the drawings) that is provided extending in the longitudinal direction of the arm portion 13. The needle bar mechanism and the thread take-up lever mechanism are driven by the sewing machine drive shaft.

A switch cluster 21 is provided in a lower portion of the front face of the arm portion 13. The switch cluster 21 includes a sewing start-and-stop switch, a reverse stitch switch, a needle up-and-down switch and the like.

A presser bar (not shown in the drawings) is disposed to the rear of the needle bar, and a presser foot 30, which is used to apply pressure to the work cloth, is mounted on the lower end of the presser bar.

The ultrasonic pen 91 will be explained with reference to FIG. 1. The sewing machine 1 can identify a position of the ultrasonic pen 91 based on an ultrasonic wave transmitted from the ultrasonic pen 91 and on a transmission start signal (to be explained later). Thus, for example, when a user uses the ultrasonic pen 91 to specify a position on which sewing is to be performed on the work cloth 100, the sewing machine 1 can identify the specified position and can perform the sewing in that location. Further, the sewing machine 1 can identify positions (coordinates) of the receivers 94 and 95 that are attached in given positions by using the ultrasonic wave transmitted by the ultrasonic pen 91.

A pen tip 911 is provided at the leading end of the ultrasonic pen 91. The pen tip 911 can move toward the inside of the pen body of the ultrasonic pen 91. Hereinafter, the direction toward the inside of the pen body of the ultrasonic pen 91 is referred to as the rearward direction of the ultrasonic pen 91. Normally, the pen tip 911 is in a protruding position in which it protrudes slightly to the outside from the pen body. When a force acts on the pen tip 911 in the rearward direction, the pen tip 911 enters into the pen body. When the force acting on the pen tip 911 is released, the pen tip 911 returns to the original protruding position. An electric circuit board (not shown in the drawings) is provided in the interior of the ultrasonic pen 91. The electric circuit board is connected to a control portion 60 (refer to FIG. 5) of the sewing machine 1, via the cable 915 that extends from the rear end of the ultrasonic pen 91.

Figure 5:
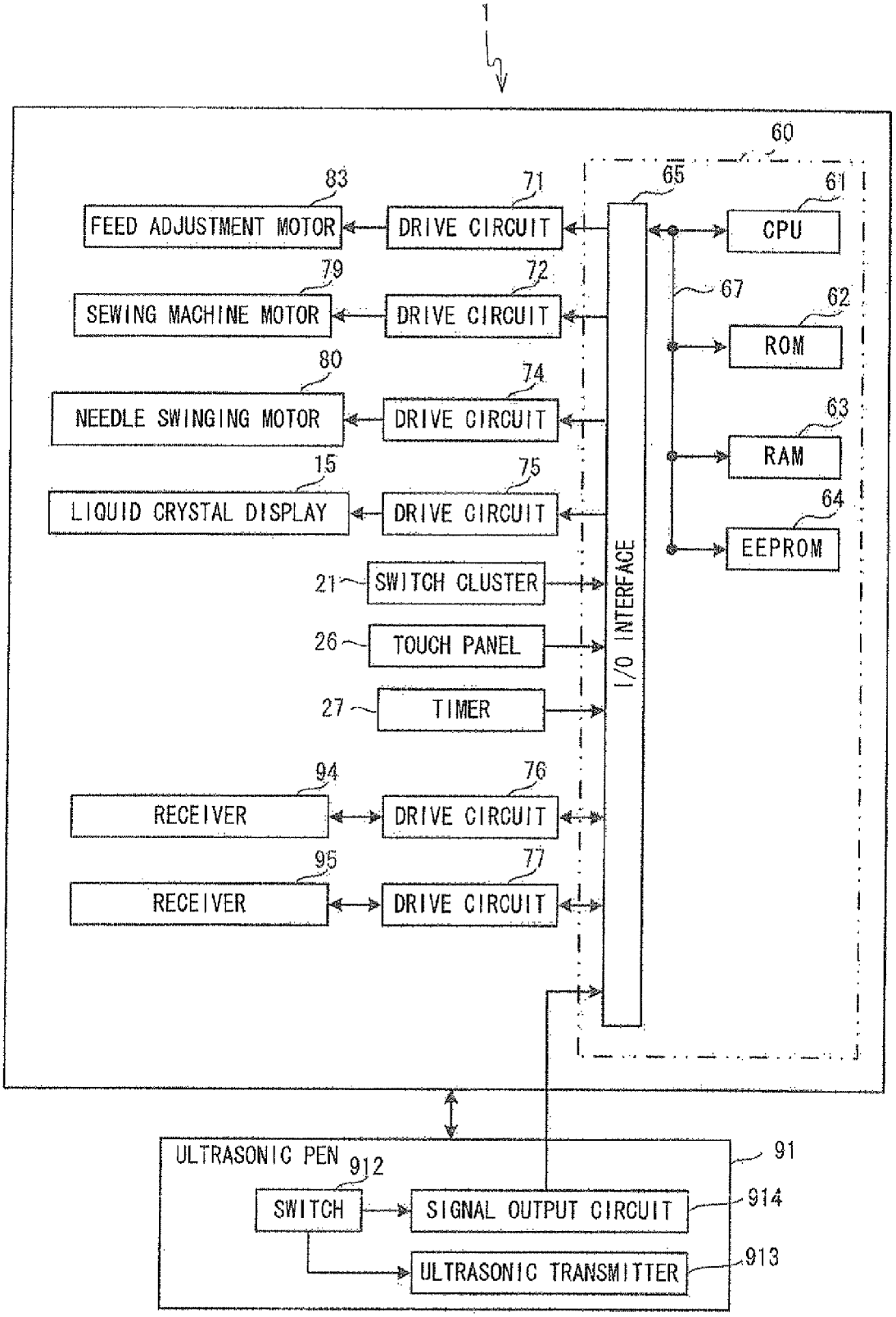
FIG. 5 is a diagram showing an electrical configuration of the sewing machine 1 and an ultrasonic pen 91.

A switch 912, an ultrasonic transmitter 913 and a signal output circuit 914 etc. are mounted on the electric circuit board (refer to FIG. 5). The switch 912 is provided facing the rear end of the pen tip 911. The ultrasonic transmitter 913 is an ultrasonic wave transmission source, and transmits an ultrasonic wave when the switch 912 is pressed. The ultrasonic transmitter 913 is provided in a position that is extremely close to the pen tip 911. The signal output circuit 914 normally outputs a "High signal" to the sewing machine 1 via the cable 915. Then, when the switch 912 is pressed, the signal output circuit 914 outputs a "Low signal" to the sewing machine 1 via the cable 915. An output timing of the Low signal is the same timing as the transmission of the ultrasonic wave from the ultrasonic transmitter 913. Namely, the Low signal is a signal (hereinafter referred as the "transmission start signal") that indicates that the transmission of the ultrasonic wave by the ultrasonic transmitter 913 has started. As described above, the signal output circuit 914 notifies the sewing machine 1 of the timing at which the ultrasonic wave is transmitted from the ultrasonic transmitter 913 by outputting the transmission start signal.

When the user holds the ultrasonic pen 91 in his or her hand and causes the pen tip 911 to touch a given position on the work cloth 100, the pen tip 911 is moved in the rearward direction. When the pen tip 911 is moved in the rearward direction of the ultrasonic pen 91, the rear end of the pen tip 911 comes into contact with the switch 912 and depresses the switch 912. When the switch 912 is depressed, the ultrasonic wave is transmitted from the ultrasonic transmitter 913. At the same time, the transmission start signal (the Low signal) is output from the signal output circuit 914. The ultrasonic wave transmitted from the ultrasonic transmitter 913 is received by the receivers 94 and 95 (refer to FIG. 1).

The receivers 94 and 95 will be explained with reference to FIG. 2 to FIG. 4. A structure of each of the receivers 94 and 95 is the same, and an explanation of the receiver 95 will therefore be omitted and the receiver 94 will be explained. In the explanation below, the lower left side, the upper right side, the upper left side, the lower right side, the upper side and the lower side in FIG. 2 respectively define the front side, the rear side, the left side, the right side, the upper side and the lower side of the receiver 94.

Figure 2:
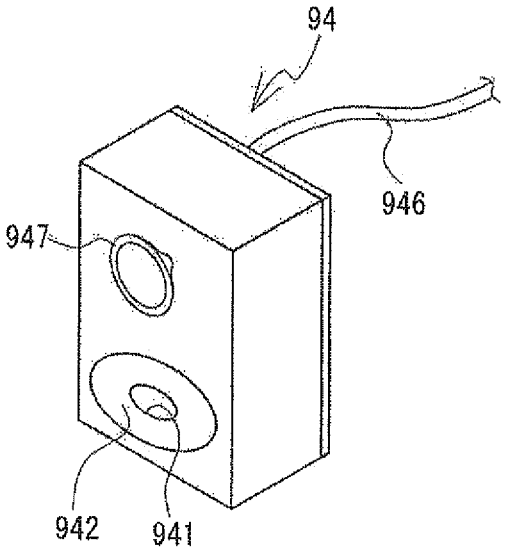
FIG. 2 is a perspective view of a receiver 94.
Figure 3:
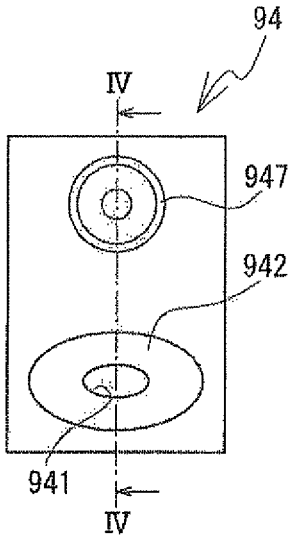
FIG. 3 is a front view of the receiver 94.
Figure 4:
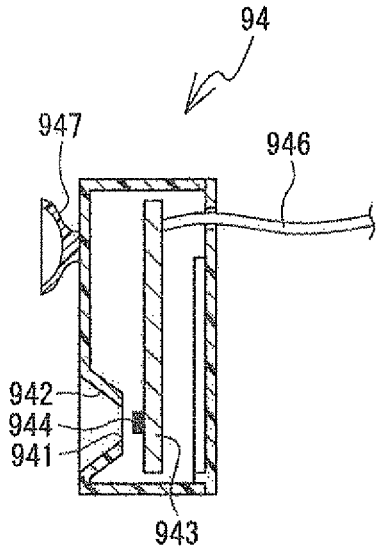
FIG. 4 is a cross-sectional view of the receiver 94 taken along a line IV-IV shown in FIG. 3, as seen in an arrow direction.

As shown in FIG. 2 to FIG. 4, the receiver 94 has a rectangular parallelepiped shape that is slightly longer in the up-down direction. The receiver 94 is mountable in a given position. An opening 941 is provided in the center of a lower portion of the front face of the receiver 94. The opening 941 has an elliptical shape that is long in the left-right direction. A wall 942 around the opening 941 is a tapered surface (an inclined surface) that expands toward the outer side. A microphone 944, which is mounted on an electric circuit board 943, is provided inside the receiver 94 to the rear of the opening 941. The electric circuit board 943 is fixed to the interior of the receiver 94.

A cable 946 is connected to the rear surface of the upper edge of the electric circuit board 943. The cable 946 passes to the rear side of the receiver 94, is connected to the rear surface of the pillar 12, and is electrically connected to a drive circuit 76 (FIG. 5) that will be explained later. The microphone 944 of the receiver 94 receives the ultrasonic wave transmitted from the ultrasonic transmitter 913. The receiver 94 outputs the received ultrasonic wave, as an electrical signal, to the sewing machine 1 via the cable 946. The sewing machine 1 detects the ultrasonic wave in this way.

A suction cup 947 is provided on an upper portion of the front surface of the receiver 94. The suction cup 947 attaches the receiver 94 to the sewing machine 1. The receiver 94 can be detachably attached by causing the suction cup 947 to be attached by suction to the sewing machine 1 in a given position. Note that, instead of the sewing machine 1, the suction cup 947 may be attached to any known device, such as an auxiliary table, an embroidery device, an embroidery frame attached to an embroidery device, various attachments mounted on the presser bar, a thread spool stand on which a plurality of thread spools are placed, or a work table on which the sewing machine 1 is placed. Further, a position in which the suction cup 947 is provided on the receiver 94 is not limited. For example, the suction cup 947 may be provided on the upper surface, a side surface or the rear surface of the receiver 94. Further, a structure can be adopted in which the position of the suction cup 947 can be changed by the user as desired.

An electrical configuration of the sewing machine 1 will be explained with reference to FIG. 5. As shown in FIG. 5, the control portion 60 of the sewing machine 1 is provided with a CPU 61, a ROM 62, a RAM 63, an EEPROM 64 and an input/output interface 65, which are mutually connected via a bus 67. The ROM 62 stores programs, data of a plurality of types of sewing patterns, and the like that are used by the CPU 61 to execute processing. The EEPROM 64 stores set values etc. that are used for the sewing machine 1 to perform sewing.

The switch cluster 21, the touch panel 26, a timer 27, the drive circuit 76 and drive circuits 71, 72, 74, 75, 76 and 77 are electrically connected to the input/output interface 65. The timer 27 measures time. The drive circuit 71 drives the feed adjustment motor 83. The drive circuit 72 drives the sewing machine motor 79. The drive circuit 74 drives the needle swinging motor 80. The drive circuit 75 drives the LCD 15. The drive circuit 76 drives the receiver 94. The drive circuit 77 drives the receiver 95. The drive circuits 76 and 77 include amplifier circuits that amplify the electrical signals output from the receivers 94 and 95 and transmit the amplified electrical signals to the CPU 61.

As described above, the switch 912, the ultrasonic transmitter 913 and the signal output circuit 914 are mounted on the electric circuit board inside the ultrasonic pen 91. The switch 912 is connected to the ultrasonic transmitter 913 and to the signal output circuit 914. The signal output circuit 914 is connected to the CPU 61 via the input/output interface 65. The signal output circuit 914 outputs the transmission start signal to the CPU 61.

A calculation method used to calculate the position of the ultrasonic wave transmission source on the work cloth 100, namely the position specified by the user using the ultrasonic pen 91, will be explained. In the following explanation, the left-right direction of the sewing machine 1 is the X direction (X coordinates), the front-rear direction of the sewing machine 1 is the Y direction (Y coordinates), and the up-down direction of the sewing machine 1 is the Z direction (Z coordinates). As described above, the sewing machine 1 can perform sewing at the position on the work cloth 100 specified by the user using the ultrasonic pen 91. Hereinafter, a calculation method used to calculate the position (X coordinate, Y coordinate) of the ultrasonic wave transmission source will be explained.

Figure 6:
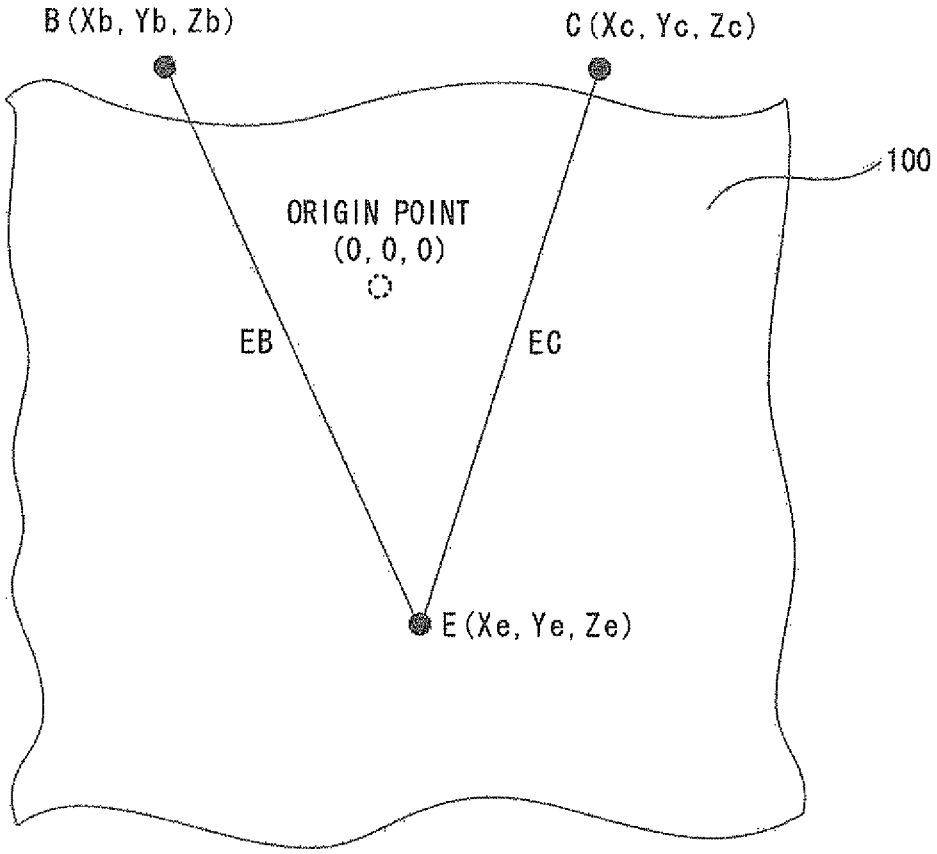
FIG. 6 is a plan view of a work cloth 100 that is placed on a sewing machine bed 11, showing positional relationships of respective coordinates in order to illustrate a calculation method of specified coordinates E.

In the following explanation, "1" in the X coordinate, the Y coordinate and the Z coordinate corresponds to a distance of "1 mm." As shown in FIG. 6, coordinates of a center position of a needle hole (not shown in the drawings) in the needle plate that is penetrated by the sewing needle 29 are assumed to be the origin point (0, 0, 0). Coordinates B that indicate the position at which the receiver 94 is disposed are denoted by (Xb, Yb, Zb) and coordinates C that indicate the position at which the receiver 95 is disposed are denoted by (Xc, Yc, Zc). Coordinates E (hereinafter referred as "specified coordinates E") of the position specified on the work cloth 100 by the user using the ultrasonic pen 91 are denoted by (Xe, Ye, Ze). A distance between the specified coordinates E and the coordinates B of the receiver 94 is referred to as a "distance EB" and a distance between the specified coordinates E and the coordinates C of the receiver 95 is referred to as a "distance EC."

A height indicated by 0 in the Z coordinate corresponds to a height of the upper surface of the needle plate. Note that the upper surface of the sewing machine bed 11 and the upper surface of the needle plate are substantially the same height, and therefore the height indicated by 0 in the Z coordinate may be the same as the height of the upper surface of the sewing machine bed 11. In the present embodiment, the receivers 94 and 95 can be mounted in given positions and thus the coordinates B (Xb, Yb, Zb) of the receiver 94 and the coordinates C (Xc, Yc, Zc) of the receiver 95 are different, due to the mounting positions. A method to calculate the coordinates B (Xb, Yb, Zb) of the receiver 94 and the coordinates C (Xc, Yc, Zc) of the receiver 95 will be explained later. Strictly speaking, a thickness of the work cloth 100 is added to Ze, which indicates the Z coordinate of the specified coordinates E, but as the thickness of the work cloth is extremely thin, in the present embodiment, the Ze value is deemed to be zero in the explanation. It should be noted that (Xe, Ye) may be calculated after taking the thickness of the work cloth 100 into account for Ze. In a case where the thickness of the work cloth 100 is taken into account for Ze, a structure or processing may be added that makes it possible to detect Ze obtained by taking into account the thickness of the work cloth 100.

In the case of the above-described conditions, a relationship of the following Formula (1) and Formula (2) is obtained.

$$(Xb-Xe)^2+(Yb-Ye)^2+(Zb)^2=(EB)^2 \quad (1):$$

$$(Xc-Xe)^2+(Yc-Ye)^2+(Zc)^2=(EC)^2 \quad (2):$$

Formulas (1) and (2) are, respectively, equations to calculate a spherical surface. In the present embodiment, the receivers 94 and 95 provided at the coordinates B and the coordinates C can receive the ultrasonic wave transmitted from the ultrasonic pen 91 (the ultrasonic wave transmitted from the specified coordinates E). Here, an ultrasonic wave speed is assumed to be a sonic velocity V. A time period from when the ultrasonic wave is transmitted from the specified coordinates E to when it is detected by the receiver 94, namely a time period required for the ultrasonic wave to reach the receiver 94 after being transmitted from the specified coordinates E, is a propagation time Tb. The time period from when the ultrasonic wave is transmitted from the specified coordinates E to when it is detected by the receiver 95, namely a time period required for the ultrasonic wave to reach the receiver 95 after being transmitted from the specified coordinates E, is a propagation time Tc. According to the above-described conditions, distance can be expressed by multiplying speed by time. Thus, the distance EB between the specified coordinates E and the receiver 94, and the distance EC between the specified coordinates E and the receiver 95 in Formulas (1) and (2) can be expressed by the following Formula (3) and Formula (4).

$$EB=V\times Tb \quad (3):$$

$$EC=V\times Tc \quad (4):$$

If Formulas (1) and (2) are substituted into Formulas (3) and (4), the following Formulas can be obtained.

$$(Xb-Xe)^2+(Yb-Ye)^2+(Zb)^2=(V\times Tb)^2 \quad (5):$$

$$(Xc-Xe)^2+(Yc-Ye)^2+(Zc)^2(V\times Tc)^2 \quad (6):$$

In Formula (5) and Formula (6), the coordinates B (Xb, Yb, Zb) of the receiver 94 and the coordinates C (Xc, Yc, Zc) of the receiver 95 can be identified by step S17 (refer to FIG. 9) of first position identification processing, which will be explained later. The sonic velocity V is a known value, and is stored in the ROM 62. The propagation time Tb and the propagation time Tc are identified (at step S47 in FIG. 11) by a time period between a transmission timing and a detection timing of the ultrasonic wave (to be explained later). Therefore, in the above Formulas (5) and (6), unknown values are Xe and Ye. Xe and Ye can be calculated by solving the simultaneous equations represented by the above Formulas (5) and (6). Namely, the X coordinate "Xe" and the Y coordinate "Ye" of the specified coordinates E specified on the work cloth 100 by the user using the ultrasonic pen 91 are calculated. Formulas (5) and (6) are stored in advance in the ROM 62. In the following explanation, a distance (V×Tb) between the specified coordinates E (the transmission source of the ultrasonic wave) and the receiver 94, and a distance (V×Tc) between the specified coordinates E and the receiver 95 in Formulas (5) and (6), are each referred to as a "second distance value."

Figure 7:
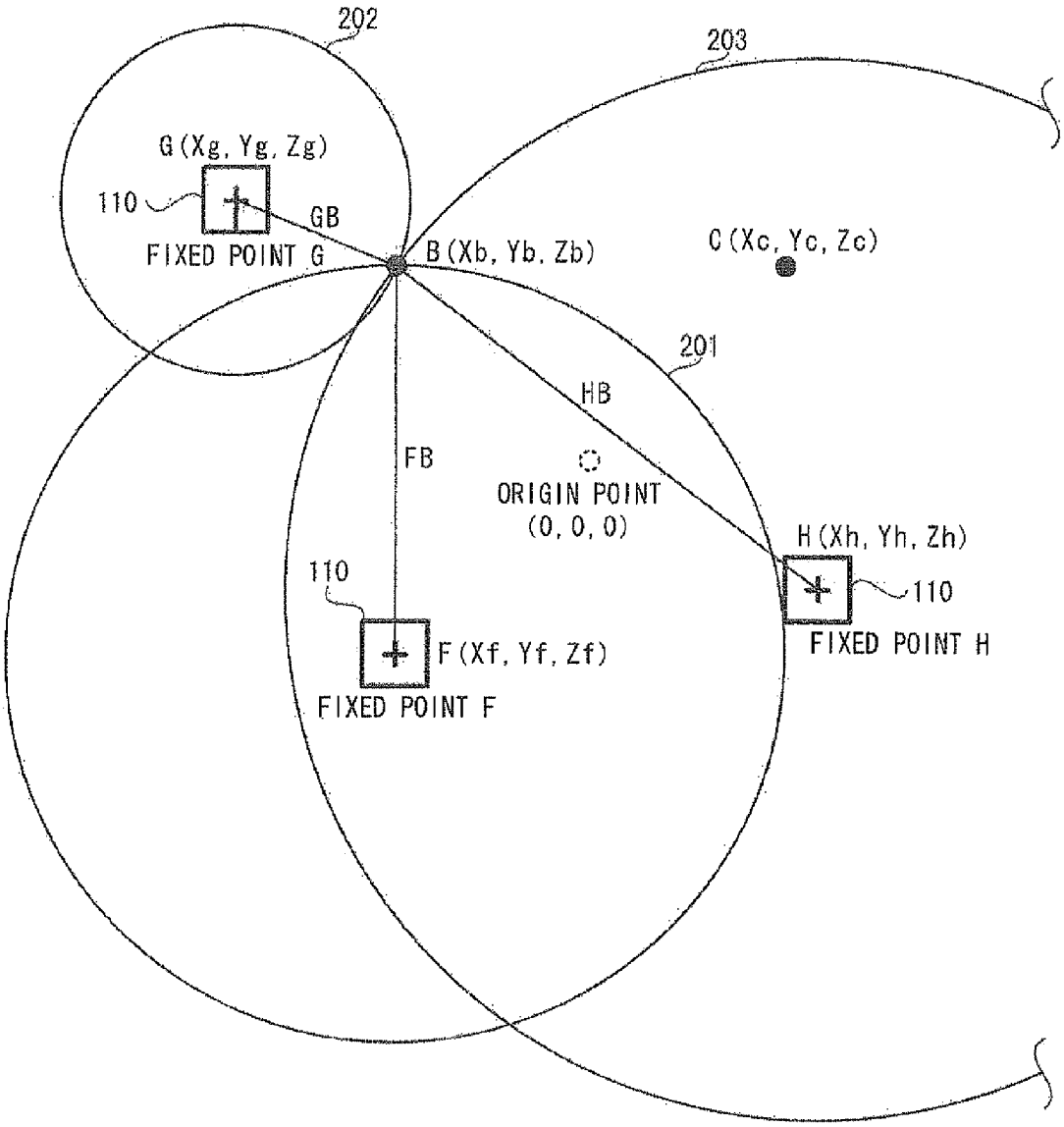
FIG. 7 is a plan view showing positional relationships of respective coordinates in order to illustrate a calculation method of coordinates B of the receiver 94.

Next, a calculation method to calculate the mounting position of the receivers 94 and 95 will be explained. As described above, the receivers 94 and 95 can be mounted in given positions. In order to perform sewing at the position specified by the ultrasonic pen 91, it is necessary to identify a position of the transmission source of the ultrasonic wave transmitted from the ultrasonic pen 91. The position of the transmission source of the ultrasonic wave is identified by calculating Formulas (5) and (6). To identify the position of the transmission source of the ultrasonic wave from Formulas (5) and (6), the coordinates B (Xb, Yb, Zb) of the receiver 94 and the coordinates C (Xc, Yc, Zc) of the receiver 95 are needed. Thus, in the present embodiment, the mounting positions of the receivers 94 and 95 that are mounted in the given positions (the coordinates B and the coordinates C) are calculated First, a method for calculating the coordinates B (Xb, Yb, Zb) of the mounting position of the receiver 94 will be explained with reference to FIG. 7. In the following explanation, as shown in FIG. 7, coordinates of a fixed point F are coordinates F (Xf, Yf, Zf). Coordinates of a fixed point G are coordinates G (Xg, Yg, Zg). Coordinates of a fixed point H are coordinates H (Xh, Yh, Zh). The coordinates of the fixed points F, G and H are stored in advance in the ROM 62. A distance between the coordinates F of the fixed point F and the coordinates B of the receiver 94 is expressed as a distance FB. A distance between the coordinates G of the fixed point G and the coordinates B of the receiver 94 is expressed as a distance GB. A distance between the coordinates H of the fixed point H and the coordinates B of the receiver 94 is expressed as a distance HB. In the present embodiment, as a specific example, the fixed points F, G and H are points on the sewing machine bed 11, but the fixed points F, G and H need not necessarily be points on the sewing machine bed 11 and may be, for example, points on the left side surface of the pillar 12.

Figure 8:
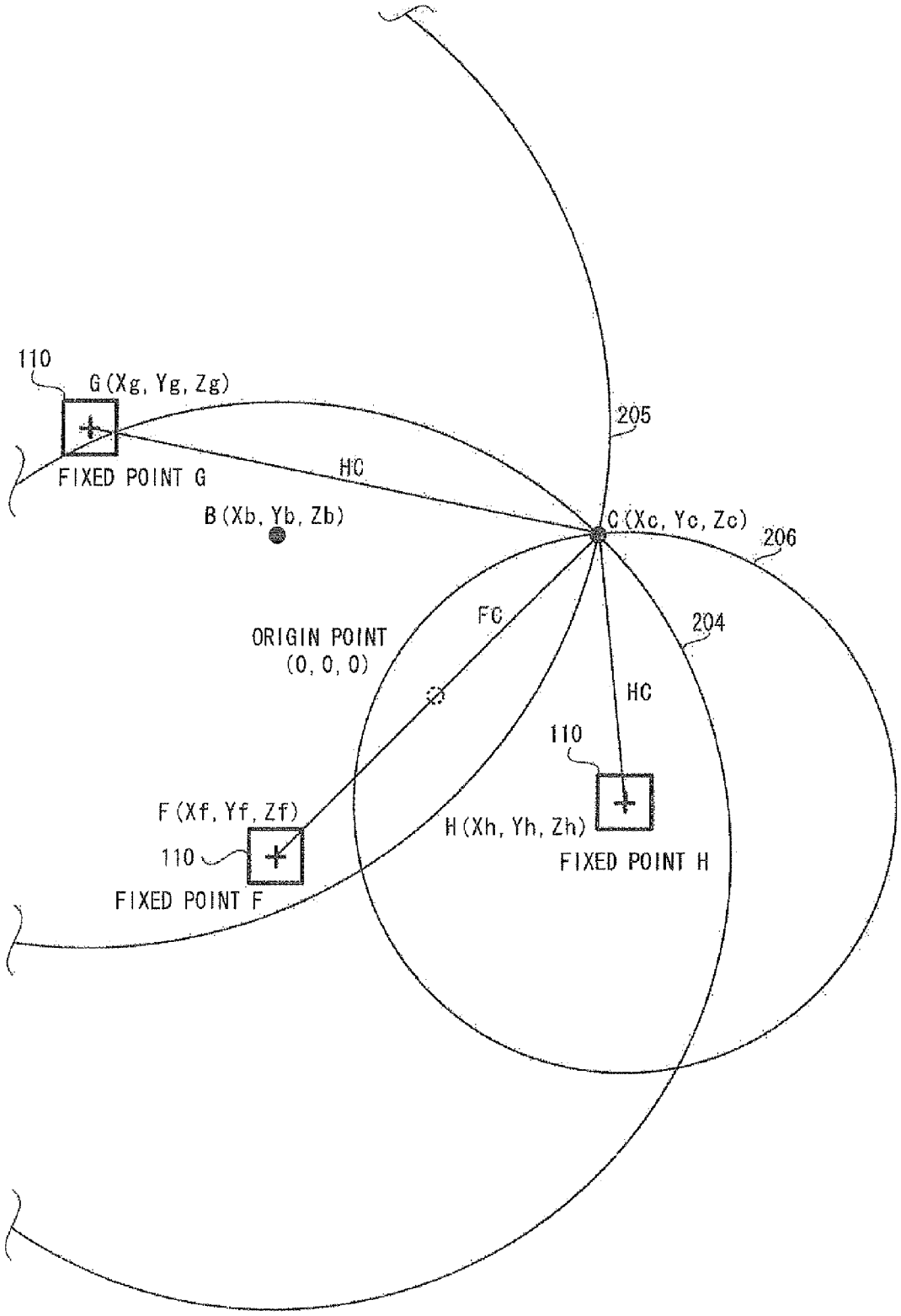
FIG. 8 is a plan view showing positional relationships of respective coordinates in order to illustrate a calculation method of coordinates C of a receiver 95.

Note that, as shown in FIG. 7 and FIG. 8, "Fixed point F," "Fixed point G" and "Fixed point H" are respectively printed, along with markers 110, on the coordinates F, G and H on the sewing machine bed 11 (not shown in FIG. 7 and FIG. 8). An instruction is displayed on the LCD 15 that prompts the user to specify the fixed points F, G and H in order using the ultrasonic pen 91. In accordance with the instruction, the markers 110 of "Fixed point F," "Fixed point G" and "Fixed point H" printed on the sewing machine bed 11 are specified in order by the user using the ultrasonic pen 91.

In a case where each of the coordinates has been defined in the manner described above, a relational expression is established between the following Formula (11), Formula (12) and Formula (13) that is used to calculate the coordinates B (Xb, Yb, Zb) of the receiver 94.

$$(Xb-Xf)^2+(Yb-Yf)^2+(Zb-Zf)^2=(FB)^2 \quad (11):$$

$$(Xb-Xg)^2+(Yb-Yg)^2+(Zb-Zg)^2=(GB)^2 \quad (12):$$

$$(Xb-Xh)^2+(Yb-Yh)^2+(Zb-Zh)^2=(HB)^2 \quad (13):$$

Formulas (11), (12) and (13) are all equations for spherical surfaces 201, 202 and 203 shown in FIG. 7. In the present embodiment, each time the fixed points F, G and H are specified in order by the ultrasonic pen 91, the ultrasonic wave transmitted from each of the fixed points F, G and H is received by the receiver 94. Here, the times required for the ultrasonic wave transmitted from each of the fixed points F, G and H to reach the receiver 94 (to be detected by the receiver 94) are, respectively, propagation time s Tfb, Tgb and Thb. As the distance can be expressed as the product of the velocity and the time, the distances FB, GB and HB can be expressed by the following Formula (14), Formula (15) and Formula (16).

$$FB=V\times Tfb \quad (14):$$

$$GB=V\times Tgb \quad (15):$$

$$HB=V\times Thb \quad (16):$$

If the above-described Formulas (11), (12) and (13) are substituted into Formulas (14), (15) and (16), the following Formulas can be obtained.

$$(Xb-Xf)^2+(Yb-Yf)^2+(Zb-Zf)^2=(V\times Tfb)^2 \quad (17):$$

$$(Xb-Xg)^2+(Yb-Yg)^2+(Zb-Zg)^2-(V\times Tgb)^2 \quad (18):$$

$$(Xb-Xh)^2+(Yb-Yh)^2+(Zb-Zh)^2=(V\times Thb)^2 \quad (19):$$

The coordinates F (Xf, Yf, Zf) of the fixed point F in Formula (17), the coordinates G (Xg, Yg, Zg) of the fixed point G in Formula (18), and the coordinates H (Xh, Yh, Zh) of the fixed point H in Formula (19) are stored in advance in the ROM 62. The sonic velocity V is stored in the ROM 62. The propagation time s Tfb, Tgb and Thb are identified by respective time periods from a transmission timing to a detection timing of the ultrasonic wave, which will be described later (step S35 in FIG. 10). Therefore, in the above Formulas (17), (18) and (19), unknown values are the coordinates B (Xb, Yb, Zb) of the receiver 94. The coordinates B (Xb, Yb, Zb) can be calculated by solving the simultaneous equations represented by the above Formulas (17), (18) and (19). Namely, the coordinates B (Xb, Yb, Zb) of the receiver 94 that is mounted by the user in a given position can be calculated. Note that the coordinates B (Xb, Yb, Zb) of the receiver 94 are an intersection point of the spherical surfaces 201, 202 and 203 (refer to FIG. 7) which have as their centers the fixed points F, G and H, respectively. The above-described Formulas (17), (18) and (19) are stored in advance in the ROM 62.

Next, a method for calculating the coordinates C (Xc, Yc, Zc) of the mounting position of the receiver 95 will be explained with reference to FIG. 8. The coordinates C (Xc, Yc, Zc) of the receiver 95 can be calculated using a similar formula to that used when calculating the coordinates B (Xb, Yb, Zb) of the receiver 94, and an explanation thereof is simplified here. In the following explanation, as shown in FIG. 8, distances between the fixed point F, the fixed point G and the fixed point H and the coordinates C of the receiver 95 are respectively expressed as a distance "FC," a distance "GC" and a distance "HC." Further, the times required for the ultrasonic wave transmitted from each of the fixed points F, G and H to reach the receiver 95 (to be detected by the receiver 95) are, respectively, propagation time s Tfc, Tgc and Thc. Given the above conditions, the following Formula (21), Formula (22) and Formula (23) are obtained.

$$FC=V\times Tfc \quad (21):$$

$$GC=V\times Tgc \quad (22):$$

$$HC=V\times Thc \quad (23):$$

Similarly to Formulas (17), (18) and (19), the following Formula (24), Formula (25) and Formula (26) are obtained.

$$(Xc-Xf)^2+(Yc-Yf)^2+(Zc-Zf)^2=(V\times Tfc)^2 \quad (24):$$

$$(Xc-Xg)^2+(Yc-Yg)^2+(Zc-Zg)^2=(V\times Tgc)^2 \quad (25):$$

$$(Xc-Xh)^2+(Yc-Yh)^2+(Zc-Zh)^2=(V\times Thc)^2 \quad (26):$$

The coordinates C (Xc, Yc, Zc) of the receiver 95 can be calculated by solving the simultaneous equations represented by the above Formulas (24), (25) and (26). Note that the coordinates C (Xc, Yc, Zc) of the receiver 95 are an intersection point of spherical surfaces 204, 205 and 206 (refer to FIG. 8) which have as their centers the fixed points F, G and H, respectively. The above-described Formulas (24), (25) and (26) are stored in advance in the ROM 62. In the explanation below, in the Formulas (17), (18), (19), (24), (25) and (26), respective distances from the transmission sources of the ultrasonic waves (namely, the fixed points F, G and H) to the receivers 94 and 95 are referred to as a "first distance value." More specifically, the distance (V×Tfb) from the fixed point F to the receiver 94, the distance (V×Tgb) from the fixed point G to the receiver 94, the distance (V×Thb) from the fixed point H to the receiver 94, the distance (V×Tfc) from the fixed point F to the receiver 95, the distance (V×Tgc) from the fixed point G to the receiver 95 and the distance (V×Thc) from the fixed point H to the receiver 95 are each referred to as the "first distance value."

The first position identification processing will be explained with reference to a flowchart in FIG. 9. The first position identification processing is performed by the CPU 61 of the sewing machine 1. The first position identification processing identifies the mounting positions (coordinates) of the receivers 94 and 95 mounted in given positions. The first position identification processing is started, for example, when an instruction to identify the mounting positions of the receivers 94 and 95 is input via a panel operation after the user has mounted the receivers 94 and 95 in the given positions. In the following explanation, as a specific example, the receivers 94 and 95 are mounted on the rear portion of the lower edge of the head portion 14, as shown in FIG. 1. Further, as shown in FIG. 7 and FIG. 8, the coordinates of the receiver 94 are the coordinates B (Xb, Yb, Zb) and the coordinates of the receiver 95 are the coordinates C (Xc, Yc, Zc).

Figure 9:
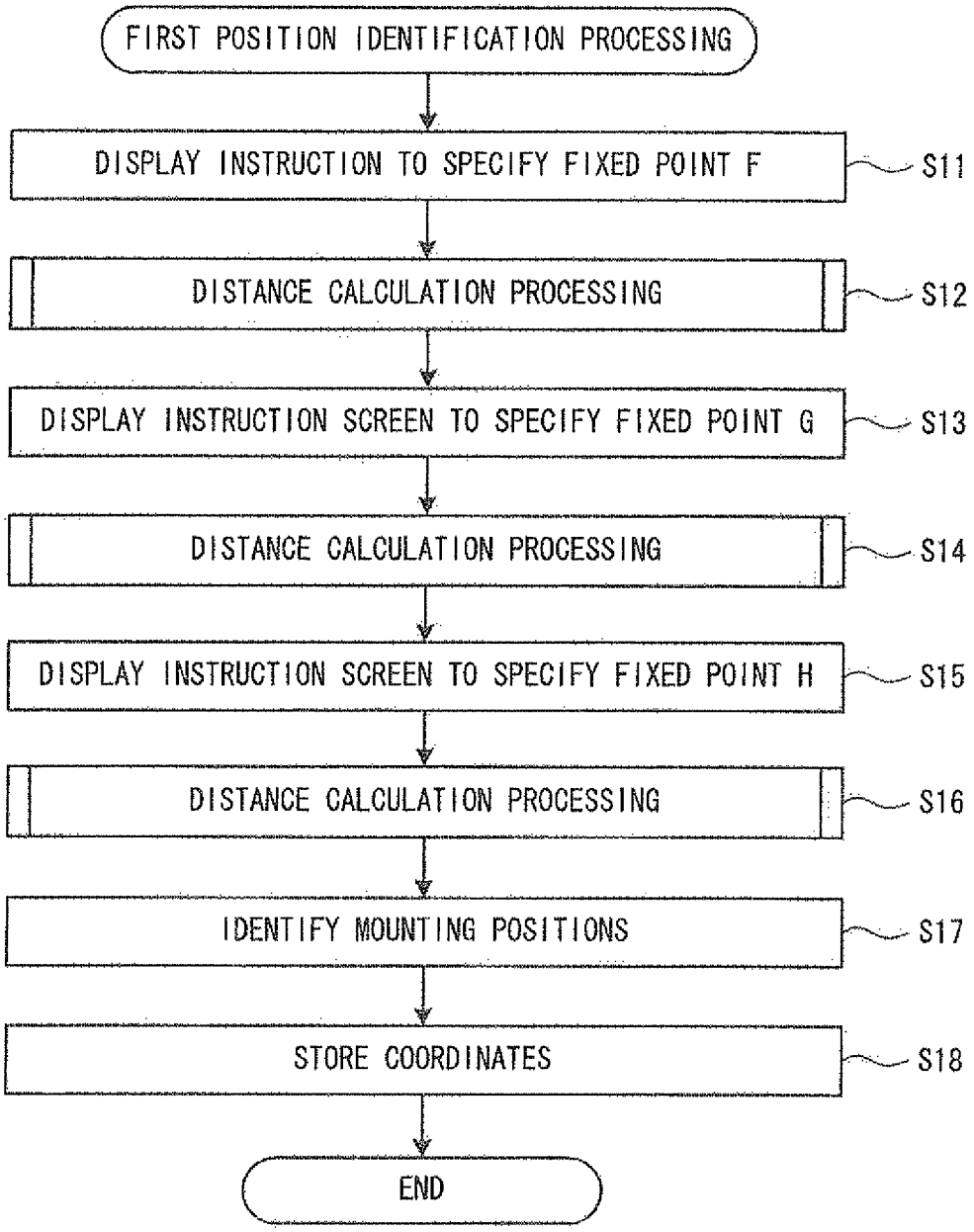
FIG. 9 is a flowchart of first position identification processing.

As shown in FIG. 9, in the first position identification processing, first, a message is displayed on the LCD 15 that instructs the user to specify the fixed point F using the ultrasonic pen 91 (step S11). At step S11, for example, a message saying "Please specify the fixed point F with the ultrasonic pen" is displayed on the LCD 15. Next, distance calculation processing is performed (step S12).

The distance calculation processing will be explained with reference to FIG. 10. The distance calculation processing is processing to calculate the first distance values from the fixed points F, G and H to the receivers 94 and 95, respectively. The distance calculation processing is performed at step S12, step S14 and step S16 (refer to FIG. 9). The first distance values from the fixed point F are calculated at step S12, the first distance values from the fixed point G are calculated at step S14 and the first distance values from the fixed point H are calculated at step S16. In the following explanation, a case will be explained in which the first distance value from the fixed point F to the receiver 94 and the first distance value from the fixed point F to the receiver 95 are calculated.

Figure 10:
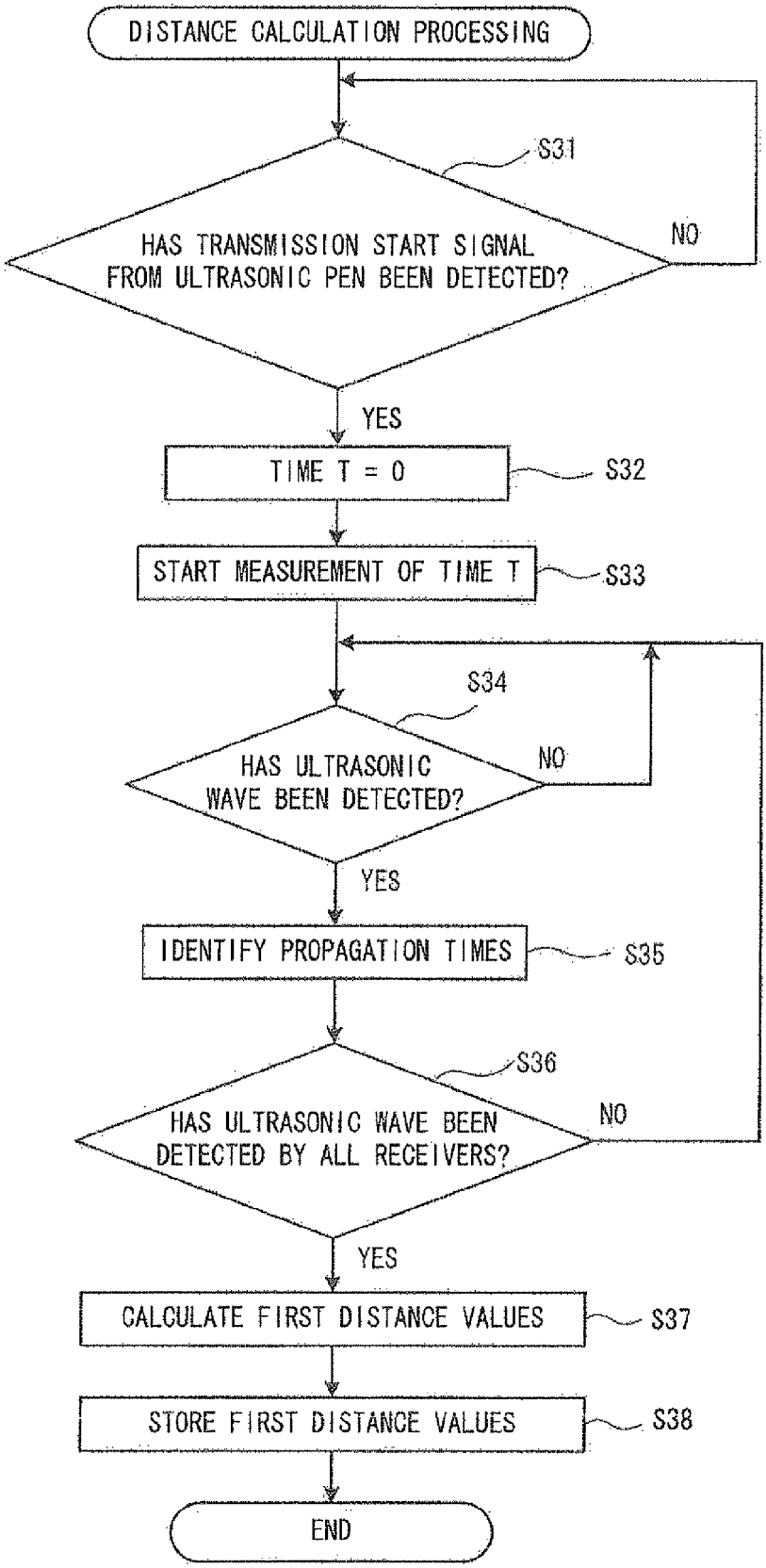
FIG. 10 is a flowchart of distance calculation processing.

As shown in FIG. 10, a determination is made as to whether the transmission start signal from the ultrasonic pen 91 has been detected (step S31). When the transmission start signal from the ultrasonic pen 91 has not been detected (no at step S31), the processing at step S31 is repeated.

When the fixed point F is specified by the user using the ultrasonic pen 91 in accordance with the instruction displayed at step S11, the transmission start signal (Low signal) is output from the ultrasonic pen 91 (the transmission timing is notified) and the transmission start signal is detected by the CPU 61. Note that the ultrasonic wave is transmitted from the ultrasonic pen 91 simultaneously with the transmission start signal, but the velocity (the sonic velocity V) of the ultrasonic wave is slower than the transmission speed of the transmission start signal and thus the ultrasonic wave reaches the receivers 94 and 95 at a later timing than a timing at which the transmission start signal is detected by the CPU 61.

When the transmission start signal has been detected (yes at step S31), a time T is set to zero (step S32). Specifically, the time T of the transmission timing at which the ultrasonic wave is transmitted is set to zero. Next, measurement of the time T by the timer 27 is started (step S33). Then, a determination is made as to whether the receiver 94 or the receiver 95 has detected the ultrasonic wave transmitted from the ultrasonic pen 91 (step S34). When the ultrasonic wave has not been detected (no at step S34), the processing at step S34 is repeated.

When the ultrasonic wave has been detected by the receiver 94 or the receiver 95 (yes at step S34), the time T at which the ultrasonic wave is detected is a propagation time (step S35). Specifically, the propagation time is a time period from the transmission timing of the ultrasonic wave to the detection timing of the ultrasonic wave detected at step S34. For example, when the ultrasonic wave is detected by the receiver 94 (yes at step S34) after the user has specified the fixed point F using the ultrasonic pen 91, the propagation time Tfb is identified (step S35). Similarly, when the ultrasonic wave is detected by the receiver 95 (yes at step S34), the propagation time Tfc is identified (step S35).

Next, a determination is made as to whether the ultrasonic wave has been detected by the receivers 94 and 95 (step S36). In a case where the ultrasonic wave has not been detected by one of either the receiver 94 or the receiver 95 (no at step S36), the processing returns to step S34. In a case where the ultrasonic wave has been detected by both the receivers 94 and 95 (yes at step S36), the first distance values are calculated (step S37). Next, the first distance values calculated at step S37 are stored in the RAM 63 (step S38).

For example, the first distance value (V×Tfb) is calculated (step S37) using the propagation time Tfb obtained at step S35 and the sonic velocity V stored in advance in the ROM 62, and the calculated first distance value is stored in the RAM 63 (step S38). Further, the first distance value (V×Tfc) is calculated (step S37) using the propagation time Tfc obtained at step S35 and the sonic velocity V stored in the ROM 62, and the calculated first distance value is stored in the RAM 63 (step S38).

Next, the distance calculation processing is ended and, as shown in FIG. 9, a message instructing the user to specify the fixed point G using the ultrasonic pen 91 is displayed on the LCD 15 (step S13). Then the distance calculation processing (refer to FIG. 10) is performed (step S14). The fixed point G is specified by the user using the ultrasonic pen 91, in accordance with the displayed message. In the distance calculation processing at step S12, the first distance value (V×Tfb) from fixed point F to the receiver 94 and the first distance value (V×Tfc) from the fixed point F to the receiver 95 are calculated. In the distance calculation processing at step S14, the propagation time Tgb from the fixed point G to the receiver 94 and the propagation time Tgc from the fixed point G to the receiver 95 are obtained (step S35), and the first distance value (V×Tgb) and the first distance value (V×Tgc) are calculated (step S37). The calculated first distance values are stored in the RAM 63 (step S38).

When the processing returns to the first position identification processing, a message is displayed on the LCD 15 instructing the user to specify the fixed point H using the ultrasonic pen 91 (step S15). Next, the distance calculation processing (refer to FIG. 10) is performed (step S16). The fixed point H is specified by the user using the ultrasonic pen 91, in accordance with the displayed message. At step S16, the propagation time Thb from the fixed point H to the receiver 94 and the propagation time The from the fixed point H to the receiver 95 are obtained (step S35), and the first distance value (V×Thb) and the first distance value (V−Thc) are calculated (step S37) and stored in the RAM 63 (step S38).

When step S16 is performed, the coordinates B (Xb, Yb, Zb) of the receiver 94 and the coordinates C (Xc, Yc, Zc) of the receiver 95, namely the mounting positions of the receivers 94 and 95, are identified (step S17). At step S17, the coordinates B (Xb, Yb, Zb) of the receiver 94 are calculated by solving the simultaneous equations represented by the above-described Formulas (17), (18) and (19). As a result, the coordinates B that are the mounting position of the receiver 94 are identified. Further, the coordinates C (Xc, Yc, Zc) of the receiver 95 are calculated by solving the simultaneous equations represented by the above-described Formulas (24), (25) and (26). As a result, the coordinates C that are the mounting position of the receiver 95 are identified.

Here, the first distance values (V×Tfb), (V×Tgb) and (V×Thb) are calculated at step S37 in FIG. 10 using the Formulas (17), (18) and (19), and the calculated first distance values are stored in the RAM 63 at step S38. Further, the coordinates F (Xf, Yf, Zf) of the fixed point F, the coordinates G (Xg, Yg, Zg) of the fixed point G and the coordinates H (Xh, Yh, Zh) of the fixed point H are stored in the ROM 62 in advance. Thus, through solving the simultaneous equations represented by the above-described Formulas (17), (18) and (19), it is possible to calculate Xb, Yb and Zb. Through the above-described calculation, the coordinates B (Xb, Yb, Zb) of the receiver 94 are identified.

Similarly, the first distance values (V×Tfc), (V×Tgc) and (V×Thc) are calculated at step S37 in FIG. 10 using Formulas (24), (25) and (26), and the calculated first distance values are stored in the RAM 63 at step S38. Further, the coordinates F (Xf, Yf, Zf) of the fixed point F, the coordinates G (Xg, Yg, Zg) of the fixed point G and the coordinates H (Xh, Yh, Zh) of the fixed point H are stored in the ROM 62 in advance. Thus, through solving the simultaneous equations represented by the above-described Formulas (24), (25) and (26), it is possible to calculate Xc, Yc and Zc. Accordingly, the coordinates C (Xc, Yc, Zc) of the receiver 95 are identified.

Next, the coordinates B (Xb, Yb, Zb) of the receiver 94 and the coordinates C (Xc, Yc, Zc) of the receiver 95 that are the mounting positions identified at step S17 are stored in the EEPROM 64 (step S18). In this way, the first position identification processing is ended. As described above, the mounting positions of the receivers 94 and 95 can be changed, but the coordinates B and C of the mounting positions of the receivers 94 and 95 are identified by performing the first position identification processing.

Sewing processing will be explained with reference to a flowchart in FIG. 11. The sewing processing is executed by the CPU 61 of the sewing machine 1. The sewing processing is started when, for example, through a panel operation by the user, a sewing pattern is selected and an instruction is input to perform the sewing. In the following explanation, as a specific example, it is assumed that the coordinates B (Xb, Yb, Zb) of the receiver 94 and the coordinates C (Xc, Yc, Zc) of the receiver 95 are identified at step S17 in the above-described first position identification processing and are stored at step S18 in the EEPROM 64 (refer to FIG. 9).

Figure 11:
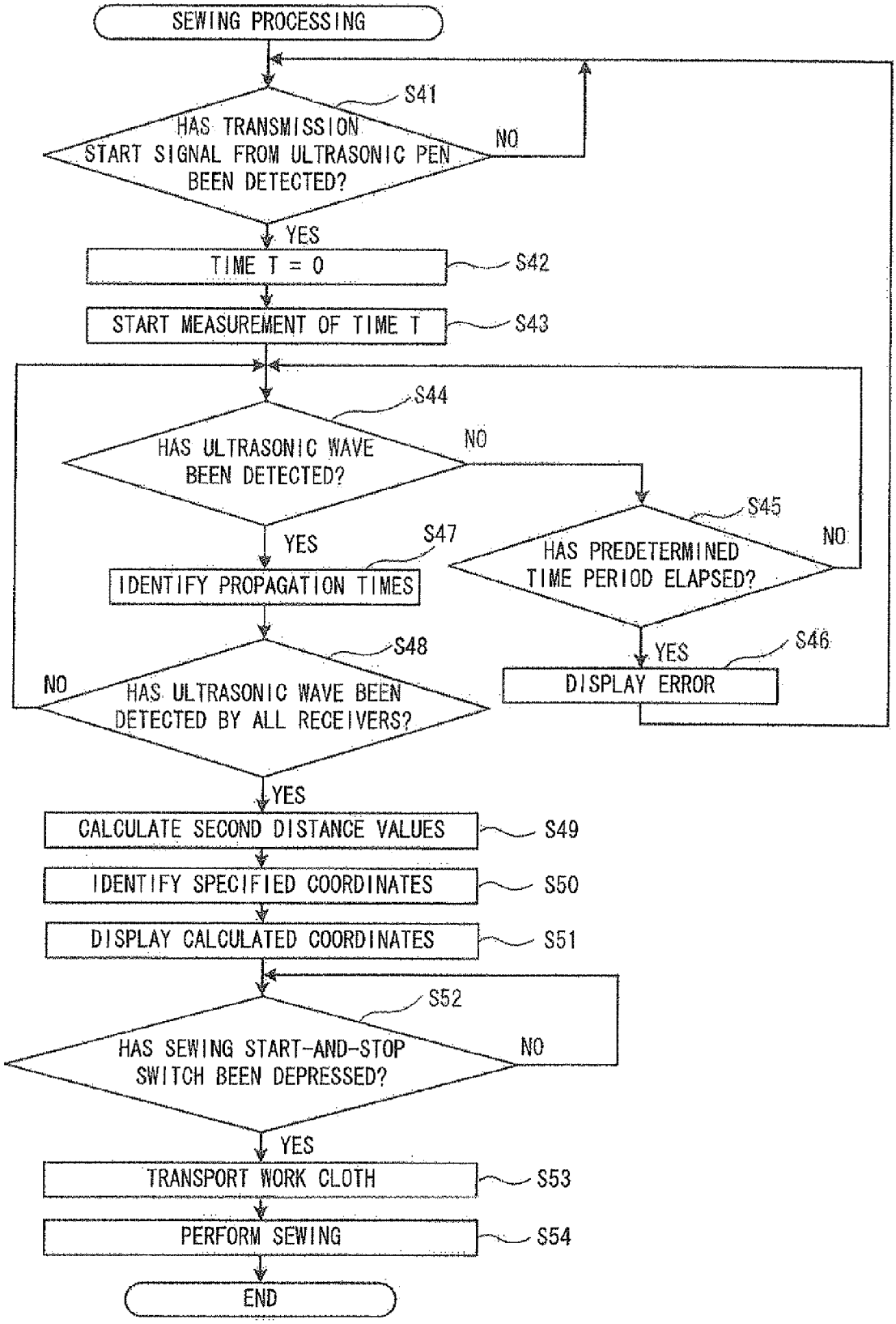
FIG. 11 is a flowchart of sewing processing.

As shown in FIG. 11, in the sewing processing, a determination is made as to whether the transmission start signal from the ultrasonic pen 91 has been detected (step S41). In a case where the transmission start signal has not been detected (no at step S41), the processing at step S41 is repeated. When the user specifies a given position (when the user specifies the specified coordinates E) on the work cloth 100 using the ultrasonic pen 91, the transmission start signal (Low signal) is output from the ultrasonic pen 91 (the transmission timing is notified) and is detected by the CPU 61.

When the transmission start signal has been detected (yes at step S41), the time T is set to zero (step S42). Specifically, the time T of the transmission timing at which the ultrasonic wave is transmitted is set to zero. Next, measurement of the time T by the timer 27 is started (step S43). Next, a determination is made as to whether the receiver 94 or the receiver 95 has detected the ultrasonic wave transmitted from the ultrasonic pen 91 (step S44). In a case where the ultrasonic wave has not been detected (no at step S44), a determination is made as to whether a predetermined time period (1 second, for example) has elapsed from the transmission timing (step S45). When the predetermined time period has not elapsed from the transmission timing (no at step S45), the processing returns to step S44. Namely, the sewing machine 1 stands by for 1 second until the ultrasonic wave is detected.

For example, in a case where the ultrasonic wave does not reach the receivers 94 and 95 due to being blocked by an obstacle or the like, the predetermined time period elapses without the ultrasonic wave being detected. When the predetermined time period elapses without the ultrasonic wave being detected (yes at step S45), an error message indicating that the ultrasonic wave has not been detected is displayed on the LCD 15 (step S46). Through the above-described processing, it is possible to notify the user that the error has occurred. Next, the processing returns to step S41.

When the ultrasonic wave is detected by the receiver 94 or by the receiver 95 within the predetermined time period (yes at step S44), the time T at which the ultrasonic wave is detected is acquired as the propagation time (step S47). In other words, the propagation time is a time period from the transmission timing of the ultrasonic wave to the detection timing of the ultrasonic wave detected at step S44. For example, when the ultrasonic wave is detected by the receiver 94 (yes at step S44), the propagation time Tb is acquired (step S47), and when the ultrasonic wave is detected by the receiver 95 (yes at step S44), the propagation time Tc is acquired (step S48).

Next, a determination is made as to whether the ultrasonic wave has been detected by both the receivers 94 and 95 (step S48). When the ultrasonic wave has not been detected by one of either the receiver 94 or the receiver 95 (no at step S48), the processing returns to step S44. When both the receivers 94 and 95 have detected the ultrasonic wave (yes at step S48), the second distance values between the transmission source of the ultrasonic wave (namely, the specified coordinates E) and each of the receivers 94 and 95 are calculated (step S49). At step S49, the propagation time s Tb and Tc acquired at step S47, and the sonic velocity V stored in the ROM 62 are used to calculate the second distance value (V×Tb) from the specified coordinates E to the receiver 94 and the second distance value (V×Tc) from the specified coordinates E to the receiver 95.

Next, a position of the transmission source of the ultrasonic wave on the work cloth 100, namely, the specified coordinates E (Xe, Ye, 0) specified by the user using the ultrasonic pen 91 are identified (step S50). Note that, as described above, the Ze value of the specified coordinates E is deemed to be "0". (Xe, Ye) are calculated at step S50 by solving the simultaneous equations represented by the above-described Formulas (5) and (6). Through the above-described calculation, the specified coordinates E (Xe, Ye, 0) are identified.

The second distance values (V×Tb) and (V×Tc) in Formulas (5) and (6) are calculated. The coordinates B (Xb, Yb, Zb) of the receiver 94 and the coordinates C (Xc, Yc, Zc) of the receiver 95 are identified in the first position identification processing (refer to FIG. 9) (step S17) and are stored in the EEPROM 64 (step S18). Thus, unknown values in Formulas (5) and (6) are only Xe and Ye. Xe and Ye can be calculated by solving the simultaneous equations represented by the above-described Formulas (5) and (6). As a result, the specified coordinates E (Xe, Ye, 0) are identified.

Next, the specified coordinates E (Xe, Ye, 0) (namely, the position of the transmission source of the ultrasonic wave) is displayed on the LCD 15 (step S51). Through the above-described processing, the specified coordinates E of the position specified by the user are notified to the user. Note that an error message may be displayed in a case where, for example, the specified coordinates E are coordinates outside a range in which the work cloth 100 can be transported and thus caused to move to the needle drop point.

Next, a determination is made as to whether the sewing start-and-stop switch included in the switch cluster 21 has been depressed (step S52). In a case where the sewing start-and-stop switch has not been depressed (no at step S52), the processing at step S52 is repeated. In a case where the sewing start-and-stop switch has been depressed (yes at step S52), the feed dog 34 is driven and the work cloth 100 is transported (step S53) such that the X coordinate Xe and the Y coordinate Ye of the specified coordinates E identified at step S50 are positioned at the needle drop point (a needle hole center in the needle plate). It should be noted that the position indicated by the X coordinate and the Y coordinate of the specified coordinates E is the position, on the work cloth 100, of the transmission source of the ultrasonic wave. Next, sewing is performed on the work cloth 100 (step S54). By the processing at step S53 and step S54, the sewing is started from the position (the specified coordinates E) specified by the user. When the sewing is complete, the sewing processing ends.

The processing of the present embodiment is performed as described above. In the present embodiment, when the user specifies a position using the ultrasonic pen 91 on the work cloth 100, the position of the transmission source of the ultrasonic wave (the position specified by the user) is identified based on the ultrasonic wave detected by the receivers 94 and 95 (step S50).

In other words, the position on the work cloth 100 on which the sewing is to be performed can be easily set by the user using the ultrasonic pen 91. Further, based on the identified position of the transmission source of the ultrasonic wave, the sewing is performed at the position specified by the user on the work cloth 100 using the ultrasonic pen 91 (step S53 and step S54). As a result, it is possible to perform the sewing at the position on the work cloth 100 set by the user, and convenience is thus improved.

In addition, as the mounting position of each of the receivers 94 and 95 can be changed (the receivers 94 and 95 can be mounted in given positions), the user can arrange each of the receivers in a position that does not interfere with the sewing operation. As a result, efficiency of the sewing operation is improved.

Furthermore, when the sewing is performed, in order to accurately identify the transmission source of the ultrasonic wave transmitted from the ultrasonic pen 91 (the position specified by the user), it is necessary to solve the simultaneous equations represented by Formulas (5) and (6), for example. Then, in order to solve the simultaneous equations, it is necessary to identify the mounting positions of the receivers 94 and 95 (the coordinates B and the coordinates C). In the present embodiment, although the mounting positions of the receivers 94 and 95 can be changed, even when the mounting positions are changed, it is possible to identify the mounting positions (the coordinates B and the coordinates C) (step S17). Thus, even if the mounting positions of the receivers 94 and 95 are changed, the position of the transmission source of the ultrasonic wave can be accurately identified.

In addition, in the present embodiment, the first distance values with respect to the receivers 94 and 95 are calculated (step S37) using the propagation time s Tfb, Tgb, Thb, Tfc, Tgc and The that are identified by the time periods from the transmission timing to the detection timing of the ultrasonic waves transmitted from the three fixed points F, G and H. Namely, the first distance values are calculated based on the transmission timing and the detection timing.

Then, the mounting positions of the receivers 94 and 95 are identified based on the calculated first distance values and on the coordinates of the fixed points F, G and H stored in advance in the ROM 62 (step S17). As the mounting positions of the receivers 94 and 95 can be identified in the manner described above based on the transmission timing and the detection timing of the ultrasonic waves transmitted from the three fixed points F, G and H, it is possible to mount the receivers 94 and 95 in given positions. Thus, the receivers 94 and 95 can be arranged in positions that do not interfere with the sewing operation. As a result, efficiency of the sewing operation is improved.

Also, the receivers 94 and 95 are each provided with the suction cup 947 and thus, the receivers 94 and 95 can be easily mounted (attached by suction) in given positions. As a result, user convenience is improved.

A second embodiment will be explained. In the first embodiment, the mounting positions of the receivers 94 and 95 are identified based on the ultrasonic waves transmitted from the three fixed points F, G and H. In the second embodiment, a plurality of mounting portions, on which the receivers 94 and 95 can be mounted, are provided on the sewing machine 1, and the receivers 94 and 95 are respectively mounted on two of the mounting portions selected by the user, from among the plurality of mounting portions.

Figure 12:
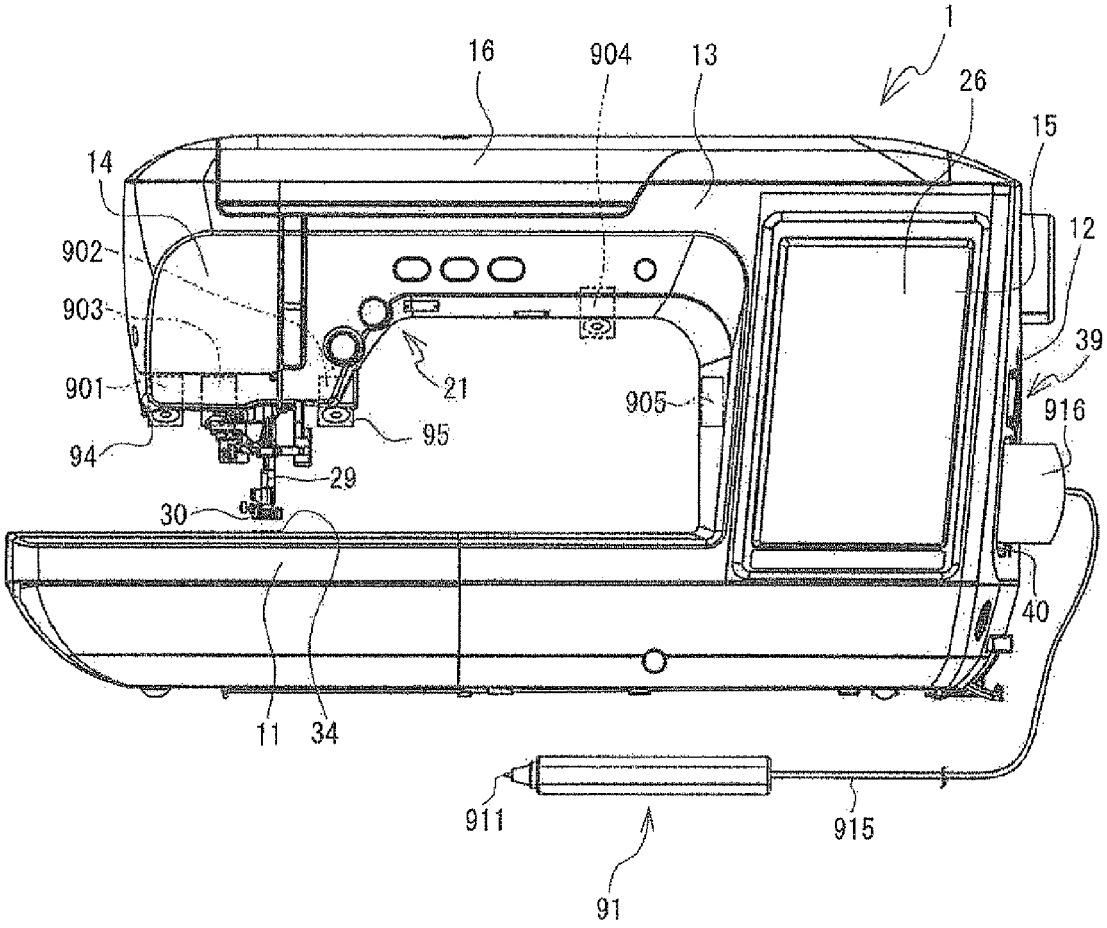
FIG. 12 is a front view of the sewing machine 1 according to a second embodiment.

As shown in FIG. 12, in the second embodiment, a plurality of (five, as an example) mounting portions 901, 902, 903, 904 and 905 are provided on the sewing machine 1. The receivers 94 and 95 can be mounted on any of the mounting portions 901 to 905. FIG. 12 shows a state in which the receiver 94 is mounted on the mounting portion 901 and the receiver 95 is mounted on the mounting portion 902. The mounting portions 903 to 905 indicated by dotted lines show a state in which the receiver 94 is hypothetically mounted.

The mounting portion 901 and the mounting portion 902 are provided, separated from each other in the left-right direction, on the lower portion of the rear edge of the head portion 14. The mounting portion 903 is provided on the front edge of the lower portion of the head portion 14. In a case where the receiver 94 is mounted on the mounting portion 903, an opening of the receiver 94 faces diagonally downward and to the rear. The mounting portion 904 is provided on the right rear portion of the arm portion 13. In a case where the receiver 94 is mounted on the mounting portion 904, the opening portion of the receiver 94 faces diagonally downward and to the front. The mounting portion 905 is provided on the left side surface of the pillar 12. In a case where the receiver 94 is mounted in the mounting portion 905, the opening portion of the receiver 94 faces to the left.

Note that, although not shown in the drawings, the mounting portions 901 to 905 are provided with a mark having a predetermined shape (a square shape, for example) and a number (or a symbol) that can be distinguished by the user. Each of the receivers 94 and 95 is mounted by the user in alignment with the mark of the selected mounting portion. The coordinates of the mounting portions 901 to 905 are stored in advance in the ROM 62 of the sewing machine 1.

Second position identification processing will be explained with reference to a flowchart shown in FIG. 13. The second position identification processing is performed by the CPU 61 of the sewing machine 1. The second position identification processing identifies the mounting positions (coordinates) of the receivers 94 and 95 mounted by the user on two of the mounting portions 901 to 905. The second position identification processing is started, for example, after the receivers 94 and 95 have been mounted in two of the mounting portions 901 to 905 and an instruction has been input by a panel operation to identify the mounting positions of the receivers 94 and 95.

Figure 13:
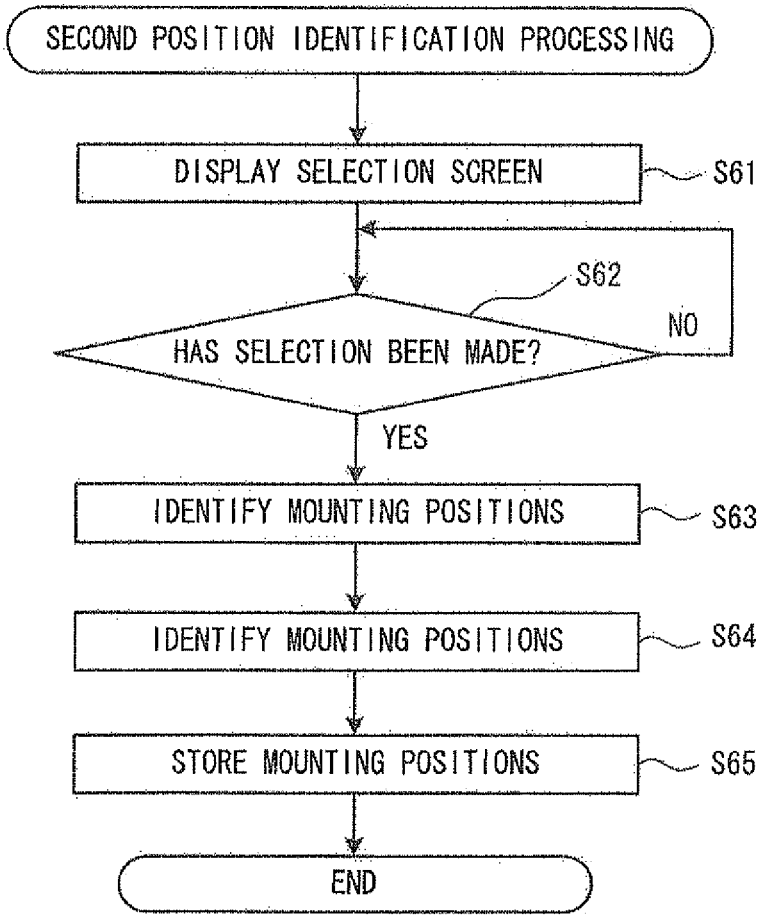
FIG. 13 is a flowchart of second position identification processing.

As shown in FIG. 13, in the second position identification processing, first, a selection screen is displayed on the LCD 15 (step S61) in order to cause the user to select, from the mounting portions 901 to 905, the two mounting portions on which the receivers 94 and 95 have been mounted. On the selection screen, for example, a list of numbers of the above-described mounting portions 901 to 905 is displayed. From the displayed list, the mounting portions on which the receivers 94 and 95 are mounted are selected by the user by a panel operation.

Next, a determination is made as to whether the mounting portions have been selected by the user by the panel operation (step S62). When the mounting portions have not been selected (no at step S62), the processing at step S62 is repeated. When the mounting portions have been selected (yes at step S62), the mounting portions selected by the user are identified as the mounting portions on which the receivers 94 and 95 are mounted (step S63).

Next, from among the positions (coordinates) of the plurality of mounting portions 901 to 905 stored in the ROM 62, the positions of the mounting portions identified at step S63 are identified as the mounting positions (the coordinates B (Xb, Yb, Zb) of the receiver 94 and the coordinates C (Xc, Ye, Zc) of the receiver 95) (step S64). Next, the mounting positions identified at step S64 (the coordinates B and the coordinates C) are stored in the EEPROM 64 (step S65). The second position identification processing is ended in this manner.

After the second position identification processing has ended, if the sewing pattern is selected, for example, by the user by a panel operation and an instruction is input to perform the sewing, the sewing processing shown in FIG. 11 is started. In the second embodiment, the coordinates B (Xb, Yb, Zb) of the receiver 94 and the coordinates C (Xc, Yc, Zc) of the receiver 95 that are identified at step S64 and stored in the EEPROM 64 at step S65 are used for the identification of the specified coordinates E at step S50.

The processing of the present embodiment is performed in the manner described above. In the present embodiment, the receivers 94 and 95 can be mounted on the mounting portions selected freely by the user from among the plurality of mounting portions 901 to 905. As a result, in accordance with a size of the work cloth 100, a sewing position on the work cloth 100 and so on, the receivers 94 and 95 can be mounted on the mounting portions that are in positions that do not interfere with the sewing operation. As a result, efficiency of the sewing operation is improved.

Figure 14:
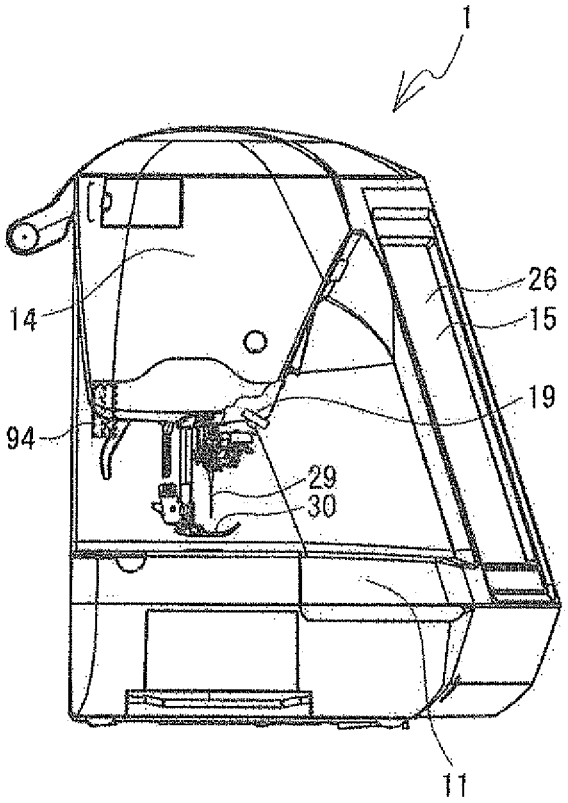
FIG. 14 is a left side view of the sewing machine 1 according to a third embodiment.

A third embodiment will be explained. In the third embodiment, mounting positions of receivers are identified based on an image captured by a camera that is an imaging device. As shown in FIG. 14, a camera 19 is mounted in the center, in the left-right direction, of the lower front portion of the head portion 14 of the sewing machine 1. Note that the position of the camera 19 shown in FIG. 14 is an example and the camera 19 may be mounted in another position on the sewing machine 1 (on the pillar 12 or on the sewing machine bed 11, for example). Alternatively, the camera 19 may be provided separately from the sewing machine 1. Further, a plurality of cameras may be provided, respectively, in different positions on the sewing machine 1. It is assumed that the camera 19 is capable of wide-angle image capture, and can capture an image of the receivers 94 and 95 mounted in selected positions on the sewing machine 1 (the receiver 95 is not shown in FIG. 14). Although not shown in FIG. 14, the camera 19 is connected to the input/output interface 65 (refer to FIG. 5) via a drive circuit (including an image processing circuit) that drives the camera 19.

Third position identification processing will be explained with reference to a flowchart shown in FIG. 15. The third position identification processing is performed by the CPU 61 of the sewing machine 1. The third position identification processing identifies the mounting positions (coordinates) of the receivers 94 and 95 that are mounted in given positions. The third position identification processing is started, for example, after the receivers 94 and 95 have been mounted on the sewing machine 1 by the user and an instruction has been input by a panel operation to identify the mounting positions of the receivers 94 and 95.

Figure 15:
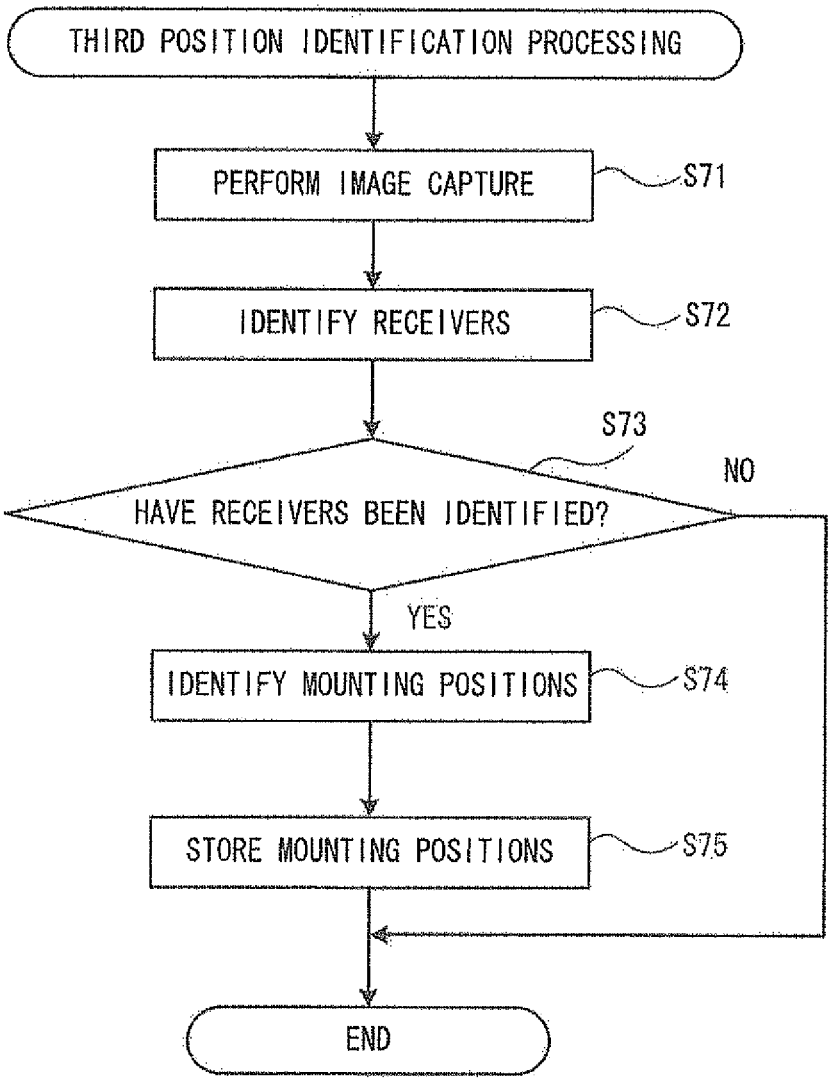
FIG. 15 is a flowchart of third position identification processing.

As shown in FIG. 15, in the third position identification processing, first, the camera 19 is controlled and an image of the sewing machine 1 is captured (step S71). Next, image recognition processing is performed and the receivers 94 and 95 in the image are identified (step S72). For example, contours of objects in the image are extracted by edge extraction, which is a known method. Next, contours of the receivers 94 and 95 are extracted by pattern matching from among the extracted contours, and the receivers 94 and 95 are thus identified. Note that the receivers 94 and 95 may be identified from the image using another method.

Next, a determination is made as to whether the receivers 94 and 95 have been identified from the image by the processing at step S72 (step S73). In a case where the receivers 94 and 95 have not been identified from the image (no at step S73), the third position identification processing is ended. In a case where the receivers 94 and 95 have been identified from the image (yes at step S73), the mounting positions (the coordinates B (Xb, Yb, Zb) of the receiver 94 and the coordinates C (Xc, Yc, Zc) of the receiver 95) are identified (step S74). At step S74, for example, positional relationships are acquired between the center (the origin point (0, 0, 0)) of the needle hole (not shown in the drawings) in the needle plate in the image captured at step S71 and the receivers 94 and 95 identified at step S74, and positions (coordinates) of the receivers 94 and 95 with respect to the origin point are identified. The mounting positions of the receivers 94 and 95 are identified by the above-described processing. Note that the mounting positions of the receivers 94 and 95 may be identified from the image using another method. Next, the mounting positions (the coordinates B and the coordinates C) identified at step S74 are stored in the EEPROM 64 (step S75). The third position identification processing is ended in this manner.

After the third position identification processing has ended, if the sewing pattern is selected, for example, by the user by a panel operation and an instruction is input to perform the sewing, the sewing processing shown in FIG. 11 is started. In the third embodiment, the coordinates B (Xb, Yb, Zb) of the receiver 94 and the coordinates C (Xc, Yc, Zc) of the receiver 95 that are identified at step S74 and stored in the EEPROM 64 at step S75 are used for the identification of the specified coordinates E at step S50.

In the third embodiment, as described above, the mounting positions (the coordinates B and the coordinates C) of the receivers 94 and 95 can be identified based on the image of the receivers 94 and 95 captured by the camera 19. As a result, the receivers 94 and 95 can be mounted in given positions as desired by the user. Thus, the receivers can be appropriately arranged such that they do not interfere with the sewing operation, and efficiency of the sewing operation is improved.

Note that the present disclosure is not limited to the above-described embodiments, and various modifications are possible. For example, in the first embodiment, the three fixed points F, G and H are provided and the three coordinates of the fixed points F, G and H are stored in advance in the ROM 62. However, as long as at least three fixed points are provided, the number of the fixed points is not limited to three. For example, four fixed points may be provided and the coordinates of the four fixed points may be stored in the ROM 62.

Further, in the present embodiment, each of the receivers 94 and 95 is mounted by the suction cup 947. However, in place of the suction cup 947, adhesive tape or a magnet, for example, may be used that can mount the receivers 94 and 95 on another object. With the above-described structure, a detection device can easily be mounted on a sewing machine or another object using at least one of a suction cup, adhesive tape or a magnet. Alternatively, for example, a plurality of types of mounting members may be provided on the receivers 94 and 95, such as providing both the suction cup 947 and the magnet on each of the receivers 94 and 95.

Further, in the present embodiment, there are the two receivers 94 and 95, but the number of receivers is not limited to two. For example, the number of the receivers may be three or more. Even when three or more of the receivers are provided, the mounting positions of the receivers can be identified similarly to the case of the receivers 94 and 95 in the present embodiment. Further, when identifying the specified coordinates E, in addition to the above-described Formulas (5) and (6), the specified coordinates E may be identified based on directivity of the receivers 94 and 95. Furthermore, when identifying the mounting positions of the receivers 94 and 95, in addition to the above-described Formulas (17), (18), (19), (24), (25) and (26), the mounting positions of the receivers 94 and 95 may be identified based on the directivity of the receivers 94 and 95. The directivity of the receivers 94 and 95 is determined by, for example, an orientation of the opening 941 with respect to the microphone 944.

Further, in the first embodiment, the transmission timing is acquired by detecting the electrical transmission start signal (Low signal) from the ultrasonic pen 91 (step S31 in FIG. 10, step S41 in FIG. 11). However, the transmission timing may be acquired by another method. For example, the ultrasonic pen 91 may be provided with an infrared transmitter that transmits infrared rays simultaneously with the transmission of the ultrasonic wave. Then, the sewing machine 1 may be provided with an infrared detector that detects the infrared rays transmitted from the ultrasonic pen 91. Infrared rays travel at the speed of light and thus, the infrared rays reach the infrared detector substantially simultaneously with the start of transmission of the ultrasonic wave. Thus, the sewing machine 1 can consider a time point at which the infrared rays transmitted from the ultrasonic pen 91 are detected by the infrared detector to be the transmission timing.

Further, in a case where the ultrasonic pen 91 is provided with the infrared transmitter, it is not necessary to transmit the transmission start signal to the sewing machine 1 via the cable 915. Thus, for example, if a battery is provided internally in the ultrasonic pen 91 and the ultrasonic transmitter 913 and the signal output circuit 914 are driven by the battery, the cable 915 can be omitted. The ease of use of the ultrasonic pen 91 can therefore be further improved.

In addition, the sonic velocity V changes depending on the ambient temperature, and thus, for example, a temperature detector, such as a thermistor or the like, may be provided in the sewing machine 1 and may measure the temperature. The sonic velocity V corresponding to the ambient temperature may then be used.

Furthermore, the feed dog 34 is used in the transportation of the work cloth 100 at step S53. However, in place of the feed dog 34, the work cloth 100 may be transported by moving an embroidery frame that holds the work cloth 100. Specifically, a known embroidery device may be mounted on the sewing machine 1, and the work cloth 100 may be transported by moving the embroidery frame holding the work cloth 100 in the X direction and the Y direction such that the X coordinate Xe and the Y coordinate Ye of the specified coordinates E correspond to the needle drop point. Note that the specified coordinates E indicate the position, on the work cloth 100, of the ultrasonic wave transmission source that is identified at step S50.

Further, when the user specifies the fixed points F, G and H, or specifies given positions on the work cloth 100, the ultrasonic pen 91 is used above. However, the ultrasonic pen 91 need not necessarily be used, and another device that is capable of transmitting an ultrasonic wave may be used, for example, to specify the fixed points F, G and H or to specify the positions on the work cloth 100.

In addition, the receivers 94 and 95 are detachably mounted and thus, for example, after the specified coordinates E specified by the user are identified at step S50, the receivers 94 and 95 may be removed from the sewing machine 1. Even if the receivers 94 and 95 are removed from the sewing machine 1, the specified coordinates E have already been identified at step S50 and thus, at step S53 and step S54, the sewing can be performed at the specified coordinates E. As a result, when the sewing is performed, the receivers 94 and 95 are in a state of not being attached to the sewing machine 1, and do not interfere with the sewing, thus further improving operating efficiency.

What is claimed is:

1. A sewing machine comprising:

a processor; and a plurality of detection devices configured to be capable of changing mounting positions and configured to detect an ultrasonic wave; and a memory configured to store i) at least three different predetermined positions of the sewing machine and ii) computer-readable instructions that instruct the sewing machine to execute steps comprising:

identifying, when a first ultrasonic wave transmitted from a transmission source of the ultrasonic wave is detected by the detection devices, a position of the transmission source of the first ultrasonic wave, calculating each of first distance values that are distances between the at least three predetermined positions and each of the detection devices, based on (i) transmission timings of a second ultrasonic wave that is the ultrasonic wave transmitted from each of the at least three predetermined positions and (ii) detection timings of the second ultrasonic wave detected by the detection devices;

identifying the mounting positions of the detection devices based on i) the calculated first distance values and ii) the three predetermined positions, and controlling sewing based on the identified position of the transmission source of the first ultrasonic wave, wherein the position of the transmission source of the first ultrasonic wave is identified based on (a) a time required for the detected first ultrasonic wave to reach each of the detection devices from the transmission source and (b) the mounting positions of the detection devices.

2. The sewing machine according to claim 1, wherein the detection devices are each provided with a mounting device that is capable of attaching to at least one of the sewing machine and a peripheral device of the sewing machine.

3. The sewing machine according to claim 2, wherein the mounting device is at least one of a suction cup, an adhesive tape and a magnet.

4. A non-transitory computer-readable medium storing computer-readable instructions that instruct a sewing machine comprising (i) a plurality of detection devices configured to be capable of changing mounting positions and configured to detect an ultrasonic wave and (ii) a memory that stores at least three different predetermined positions of the sewing machine, to execute steps comprising:

identifying, when a first ultrasonic wave transmitted from a transmission source of the ultrasonic wave is detected by the detection devices, a position of the transmission source of the first ultrasonic wave, calculating each of first distance values that are distances between the at least three predetermined positions and each of the detection devices, based on i) transmission timings of a second ultrasonic wave that is the ultrasonic wave transmitted from each of the at least three predetermined positions and ii) detection timings of the second ultrasonic wave detected by the detection devices;

identifying the mounting positions of the detection devices based on (a) the calculated first distance values and (b) the three predetermined positions, and controlling sewing based on the identified position of the transmission source of the first ultrasonic wave, wherein the position of the transmission source of the first ultrasonic wave is identified based on a) a time required for the detected first ultrasonic wave to reach each of the detection devices from the transmission source and b) the mounting positions of the detection devices.

5. A sewing machine comprising:

a processor;

a plurality of detection devices configured to detect an ultrasonic wave, the plurality of detection devices being independent of each other, and each of the plurality of detection devices being independently mounted to the sewing machine; and a memory configured to store computer-readable instructions that instruct the sewing machine to execute steps comprising:

identifying, when a first ultrasonic wave transmitted from a transmission source of the ultrasonic wave is detected by the detection devices, a position of the transmission source of the first ultrasonic wave, based on information relating to the detected first ultrasonic wave, and controlling sewing based on the identified position of the transmission source of the first ultrasonic wave.

* * * * *